US006017009A

United States Patent [19]

Swartz et al.

[11] Patent Number: 6,017,009

[45] Date of Patent: Jan. 25, 2000

[54] SUPPORT SYSTEM WITH QUICK-ADJUST SUPPORT ASSEMBLY

[75] Inventors: Robert K. Swartz, Dallas; Willard J. Sickles, Dalton; Robert J. Welch, Dallas; Paul J. Fallon, Wilkes-Barre, all of Pa.

[73] Assignee: Metro Industries, Inc., Reno, Nev.

[21] Appl. No.: 08/973,401

[22] PCT Filed: Jun. 14, 1996

[86] PCT No.: PCT/US96/10356

§ 371 Date: Mar. 11, 1998

§ 102(e) Date: Mar. 11, 1998

[87] PCT Pub. No.: WO97/00033

PCT Pub. Date: Jan. 3, 1997

Related U.S. Application Data

[60] Provisional application No. 60/000,227, Jun. 15, 1995.

[51] Int. Cl.[7] ..... A47B 9/00

[52] U.S. Cl. ..... 248/245; 108/147.13; 108/147.14; 108/147.15; 248/295.11

[58] Field of Search ..... 248/230.2, 245, 248/411, 412; 108/147.11, 144.11, 147.12, 147.13, 147.14, 147.15; 211/187

[56] References Cited

U.S. PATENT DOCUMENTS

| | | | |
|---|---|---|---|
| 138,385 | 4/1873 | Elliot | 248/230.2 X |
| 446,472 | 2/1891 | Roberts | 248/245 |
| 2,849,249 | 8/1958 | Fridolph | 248/412 X |
| 3,424,111 | 1/1969 | Maslow . | |
| 3,472,476 | 10/1969 | Johnson | 248/245 |
| 3,604,369 | 9/1971 | Maslow . | |
| 3,675,598 | 7/1972 | Kesilman et al. . | |
| 3,964,404 | 6/1976 | Mueller et al. . | |
| 4,132,178 | 1/1979 | Mueller et al. . | |
| 4,430,017 | 2/1984 | Stefancich | 248/411 X |
| 4,596,484 | 6/1986 | Nakatani | 248/411 X |
| 4,629,077 | 12/1986 | Niblock | 211/187 |
| 4,637,323 | 1/1987 | Nicely . | |
| 5,039,043 | 8/1991 | Hodge | 248/411 X |
| 5,415,302 | 5/1995 | Carlson et al. . | |
| 5,423,251 | 6/1995 | Kolvites et al. . | |
| 5,772,162 | 6/1998 | Lin | 248/411 X |

FOREIGN PATENT DOCUMENTS

| | | |
|---|---|---|
| 2 171 291 | 8/1986 | United Kingdom . |
| 2 190 282 | 11/1987 | United Kingdom . |
| 2 207 597 | 2/1989 | United Kingdom . |

*Primary Examiner*—Derek J. Berger
*Attorney, Agent, or Firm*—Fitzpatrick, Cella, Harper & Scinto

[57] ABSTRACT

A shelf support system includes at least one support post (12), a tapered wedge member (20) located on the support post (12) and a supporting assembly (14). The supporting assembly (14) is structurally secured to a shelf frame (10) and includes a locking mechanism (18) rotatably supported by a collar (16). The locking mechanism (18) has a first position for press-fitting the wedge member (20) against the support posts (12) and a second position for allowing the shelf frame (10) to slide over the support post (12) and wedge member (20).

67 Claims, 20 Drawing Sheets

SUPPORT SYSTEM WITH QUICK-ADJUST SUPPORT ASSEMBLY

CROSS-REFERENCE TO RELATED APPLICATION

This application is a continuation-in-part of provisional application no. 60/000,227, filed Jun. 15, 1995.

BACKGROUND OF THE INVENTION

1. Field of the Invention

The present invention relates generally to an item-supporting structure that can be used to support shelving or other elements for carrying or supporting any desired item. More particularly, the present invention relates to a support assembly for use in, for example, a knock-down shelving system, to adjustably support shelves.

The support assembly of the present invention can be ideally incorporated into a knock-down shelving system that includes a plurality of support posts for supporting one or more shelves at corner support assemblies thereof. The shelving system will include a snap-on wedge member with detent means for adjustably locating the wedge member at predetermined heights on the support post. In accordance with the present invention, each corner support assembly features a collar, which is structurally associated with the shelf, and a locking mechanism, or flipper, rotatably supported by the collar and actuable between a locking position and an unlocking position. In the unlocking position, the corner support assemblies allow the shelf to translate relative to the support posts. When the flippers are locked, the collars are secured to each respective wedge member and post by a wedging action. Operation of the flipper thus permits easy height adjustment of the shelf without the need for tools, and also without compromising the load bearing capacity of the shelving system.

2. Description of the Prior Art

Shelving systems having adjustable height shelves and so-called "knock-down" type shelving systems are known, and each has utility in many applications. For example, a knockdown shelving system with adjustable height shelves may be used in food service, industrial, commercial, hospital, and similar fields for storage of any desired items.

One type of known adjustable, knockdown shelving system is disclosed in U.S. Pat. No. 3,424,111 (Maslow) and U.S. Pat. No. 3,523,508 (Maslow), which are assigned to the assignee of the subject invention. The adjustable shelving system disclosed in these patents has achieved great commercial success under assignee's trademark SUPER ERECTA SHELF. This shelving system uses a plurality of cylindrical support posts provided with a series of equally spaced, annular grooves on its outer surface. A basic shelving system might include four support posts to support one or more formed-wire shelves, with each shelf having a frusto-conicallyshaped collar at each corner for receiving a support post. A two-piece interlocking sleeve fits around the support post. The sleeve features a rib on its interior surface for engaging one of the grooves on the support post and has a frusto-conically-shaped outer surface, which is widest at the bottom, designed to complement the shape of the shelf collars. The support posts fitted with sleeves are received in the collars of each shelf to assemble the shelving system. When assembled, the weight of the shelf creates a radially-inwardly directed force between the collars and sleeves. This force brings the sleeves into a locking relation with the posts and creates a wedging force between the collars and sleeves.

While the SUPER ERECTA SHELF shelving system has proven very successful in providing an easy to assemble shelving system with a substantial load-bearing capacity, adjusting the shelves can sometimes require the use of a hammer or other tool to disengage the shelf collars from the sleeves. The weight of the shelf and any items supported thereon, especially over time, can build up the wedging force between the shelf collars and the sleeves to the point where a significant amount of force is needed to raise the shelf off of the sleeves.

A shelving system with easy to adjust shelves is provided in U.S. Pat. No. 5,415,302. This shelving system uses hanger brackets to permit easy installation and adjustment of the shelves without requiring the disassembly of the entire shelving system or the use of tools. This shelving system, known under the trademark QWIKSLOT SHELF, is also assigned to the assignee of the subject invention. The QWIKSLOT SHELF shelving system uses support posts formed with a plurality of elongated slots at regular vertical intervals for receiving the hanger brackets. The slotted support post can also have annular grooves as discussed above in the SUPER ERECTA SHELF shelving system. A notch in each hanger bracket receives a truncated corner of a shelf.

The hanger brackets used in the QWIKSLOT SHELF shelving system allow for easy adjustment of the shelves. A potential drawback in some applications, however, is that shelves secured by means of the hanger brackets do not provide the heavy-duty load bearing capacity of other shelving systems, such as the SUPER ERECTA SHELF shelving system.

Still another type of successful shelving system, sold and marketed under the trademark METROMAX and also assigned to the assignee of the subject invention, features a "knock-down" shelving system that uses triangular support posts. Such a system is the subject of U.S. Pat. No. 4,811,670, U.S. Pat. No. 4,964,350, U.S. Pat. No. 5,271,337, and U.S. Pat. No. 5,279,231.

In U.S. Pat. No. 4,811,670, a corner assembly for securing each corner of a shelf to the triangular support post includes a wedge member, a corner bracket structurally associated with the shelf and a collar. The wedge member snap-fits on the support post, and the collar and corner bracket form a sleeve around the support post. The formed sleeve fits against the support post and wedge member and supports the shelf by a wedging force.

The shelving systems in U.S. Pat. No. 4,964,350, U.S Pat. No. 5,271,337, and U.S. Pat. No. 5,279,231, feature modular shelves in combination with the triangular support posts. The modular shelves include a rectangular shelf frame formed from two end beams connected to two side beams. A center beam may be inserted between the end beams, parallel to the side beams, to increase the loadbearing capacity of the system. A plurality of plastic shelf mats are adapted to be snap-fit onto the shelf frame. The shelf frame is secured to the support post by corner assemblies comprised of a corner portion of the end beam, a wedge member and a separate collar. A sleeve formed by the corner portion and the collar is seated on the support post and wedge member and secured by a wedging action. Two lock cylinders lock the collar to the corner portion to secure the sleeve.

While the design of the modular shelf provides many advantages, adjusting the shelf can, on occasion, require use of a hammer or other tool to disengage the formed sleeve from the wedge member for the same reasons discussed above in connection with the SUPER ERECTA SHELF shelving system.

Despite the significant utility and commercial success of the above-described shelving systems, a need exists for an improved support assembly in which the shelving system may be easily assembled and the shelves easily adjusted to different heights without the need for any tools, and in which the shelves are secured in a static manner to provide a load carrying capacity suitable for heavy-duty use.

SUMMARY OF THE INVENTION

For purposes of explanation, the present invention will be described with reference to a shelving system. However, in its broadest aspect, this invention relates to a support assembly capable of use in many types of support systems. The support system can support shelves, as described below in greater detail, and other elements for carrying a wide variety of items. For example, the support system can support combinations of shelving, drawers, work surfaces, racks, bins, hooks and the like.

Accordingly, it is a principal object of the present invention to provide a shelf support assembly for use in an easy to assemble and easy to adjust heavy-duty shelving system.

Another object of the present invention is to provide a shelf support assembly that can be quickly and easily adjusted.

It is another object of the present invention to provide a shelf support assembly that is statically secured to the shelving system to provide substantial load-bearing capacity.

Still another object of the invention is to provide a shelf support assembly that is readily adaptable to various types of support posts.

In accordance with one aspect of the invention, a support system comprises a support post, a tapered wedge member located on the support post, and support means for adjustably supporting a member. The support means includes a locking mechanism having a first position for press-fitting the wedge members against the support posts and a second position for allowing the member to slide over the support posts.

In accordance with another aspect of the invention, a system for supporting a member comprises a support post having a longitudinal axis, a wedge member with a tapered face and mounted to the support post, and supporting means secured to the member for supporting the member to the support post. The supporting means is seated on the support post and the mounted wedge member and is actuable between a first position for compressing the wedge member and supporting the member and a second position not compressing the wedge member.

In accordance with yet another aspect of the invention, a system for supporting a member comprises a support post having a longitudinal axis and a wedge member with a tapered face and mounted to the support post. A collar is secured to the member, and a locking mechanism is mounted to the collar, with the locking mechanism and the collar forming a sleeve around the support post. The locking mechanism is actuable between a first position for compressing the wedge member and supporting the member and a second position not compressing the wedge member.

In accordance with still another aspect of the invention, when the locking mechanism is in the first position, the sleeve engages the support post and wedge member and is seated thereon by a wedge action.

In accordance with another aspect of the invention, when the locking mechanism is in the second position, the sleeve is slidable over the support post and the wedge member.

These and other objects, aspects, features and advantages of the present invention will become apparent from the following detailed description of the preferred embodiments taken in conjunction with the accompanying drawings.

Figure 12A:
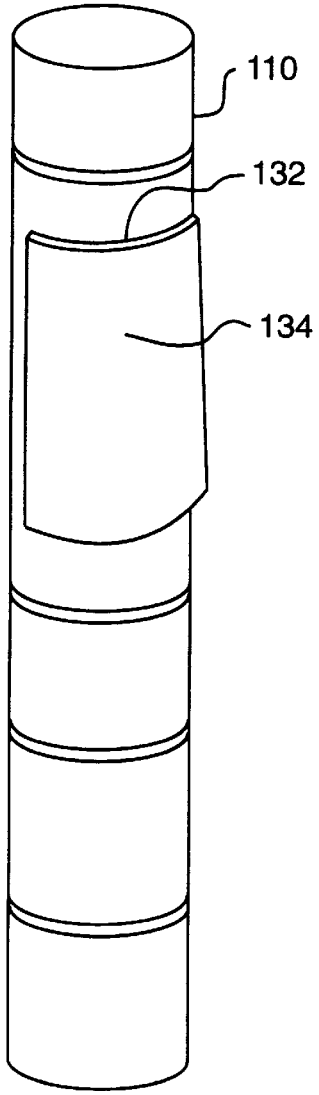
FIG. 12A is a partial perspective view of a support post and wedge member in accordance with a first modification of the second embodiment of the present invention.
Figure 14A:
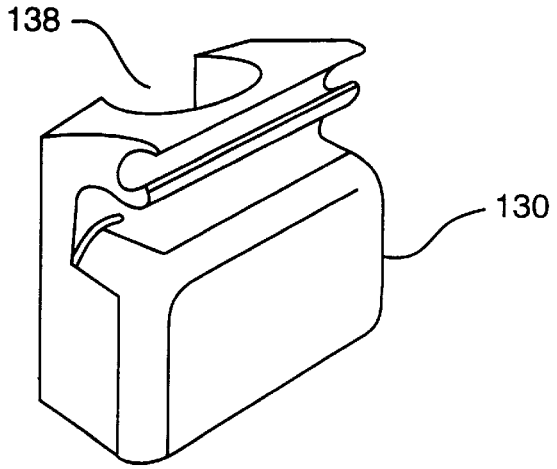
Figure 12B:
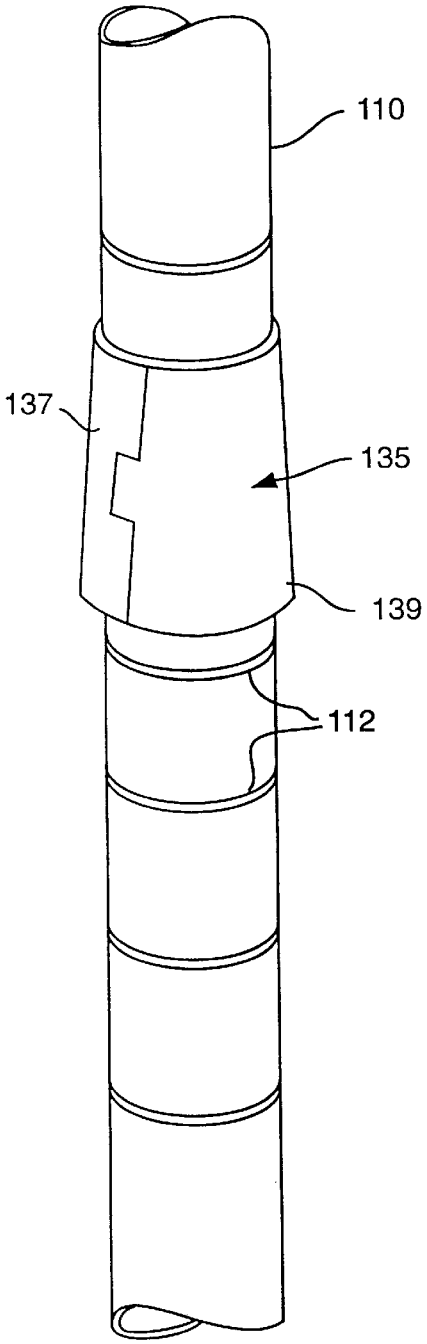
FIG. 12B is a partial perspective view of a support post and wedge member in accordance with a second modification of the second embodiment of the present invention.
Figure 13B:
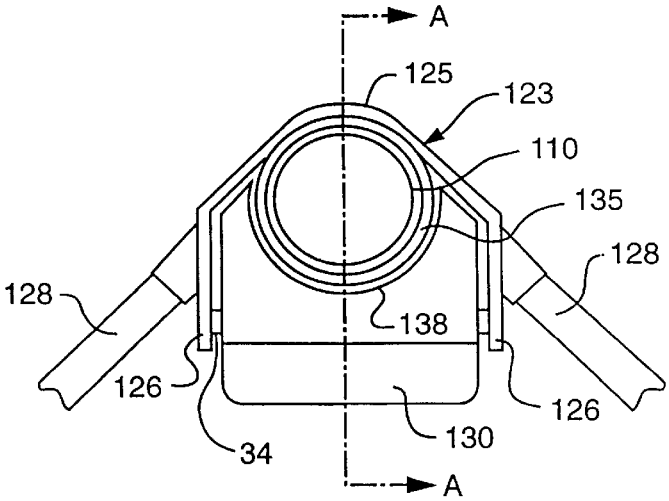
FIG. 13B is a top view of a corner of a shelving system in accordance with the modified embodiment shown in FIG. 12B.
Figure 14B:
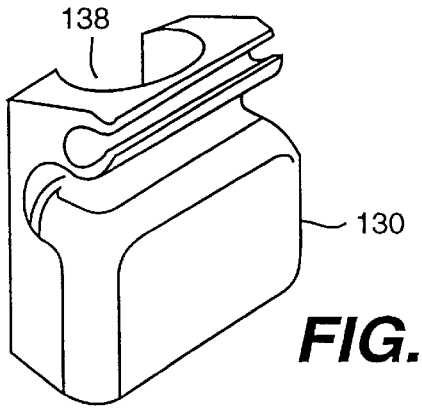
Figure 23:
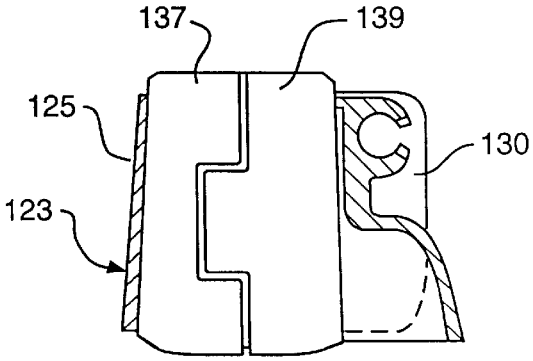
Figure 15:
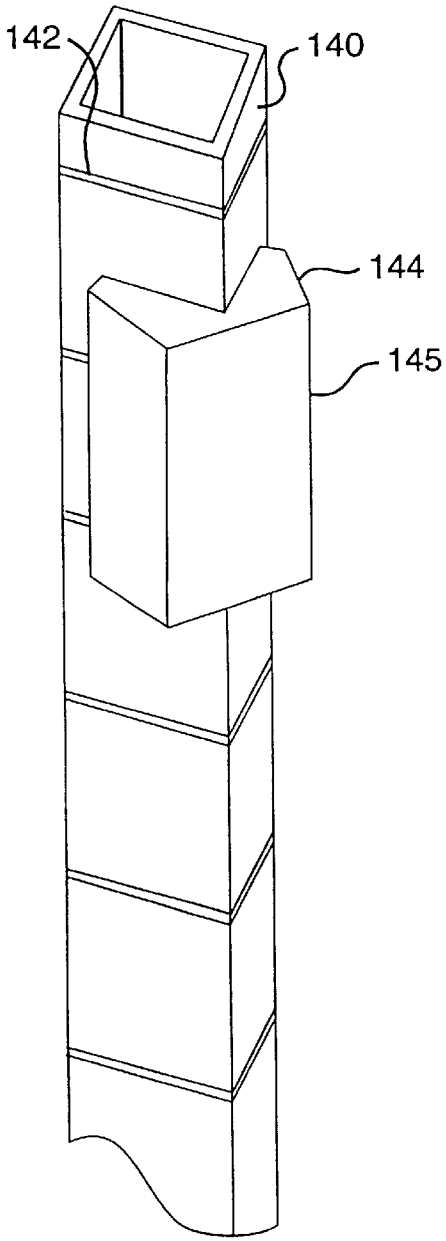
Figure 16:
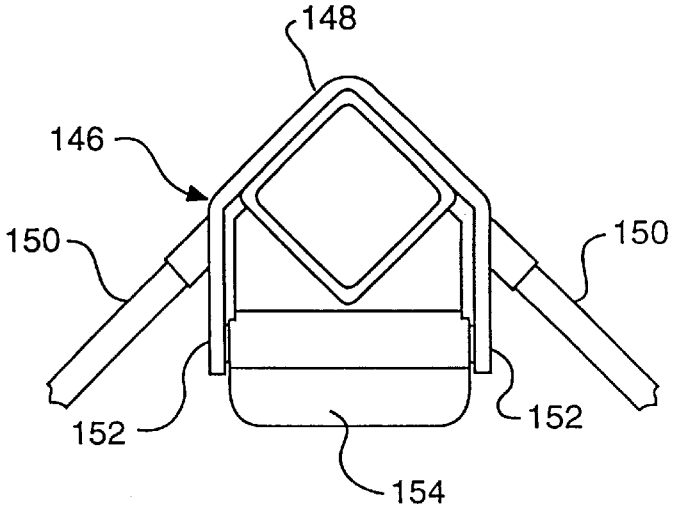
Figure 17:
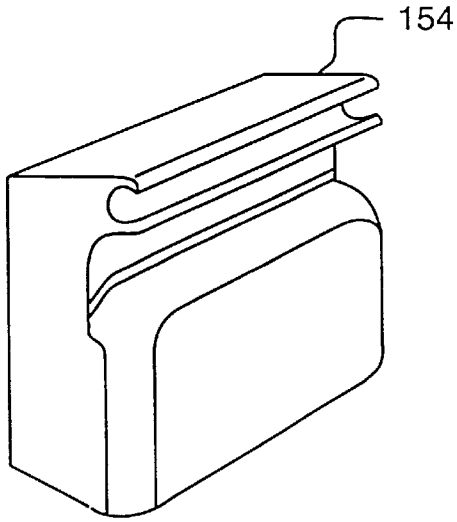
Figure 18:
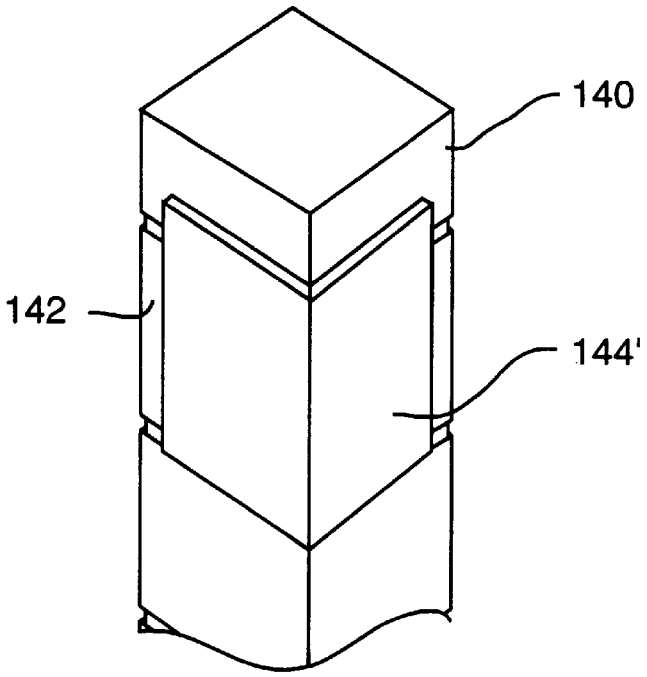
Figure 19:
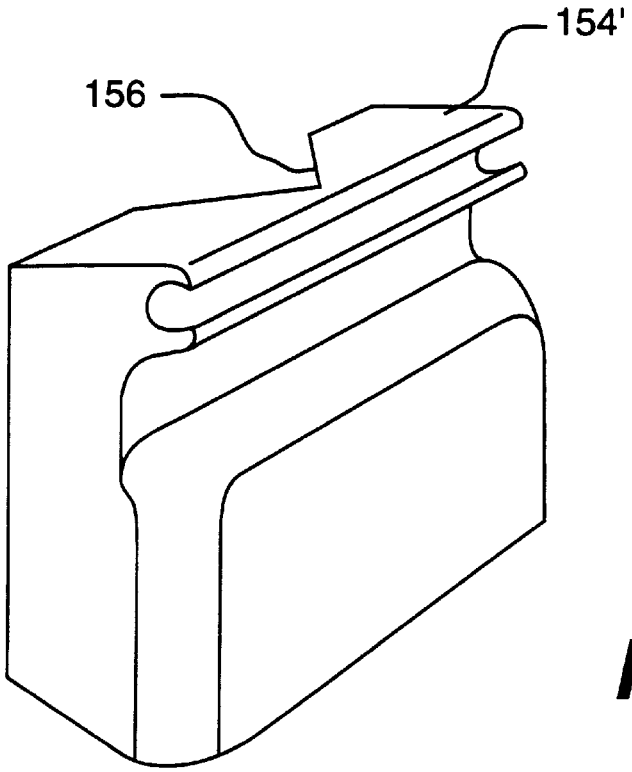
Figure 20:
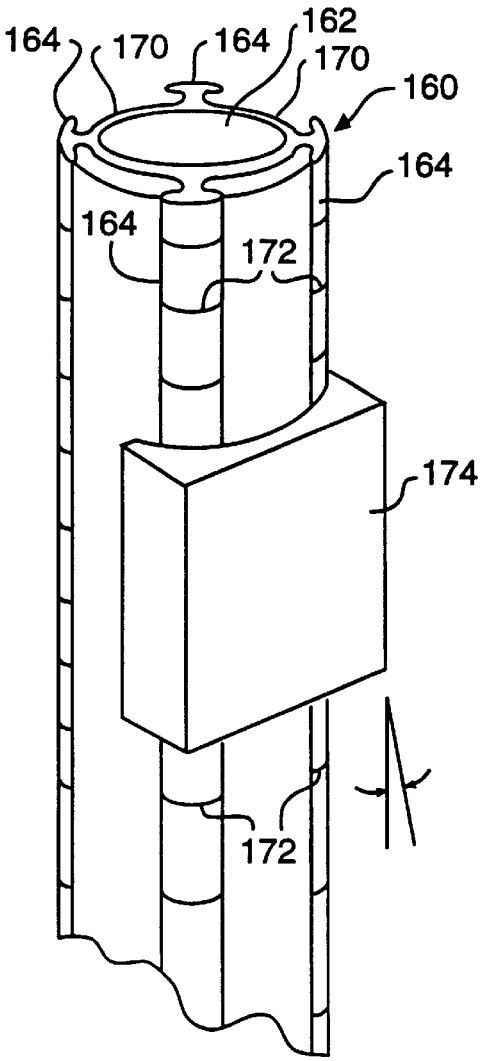
Figure 21:
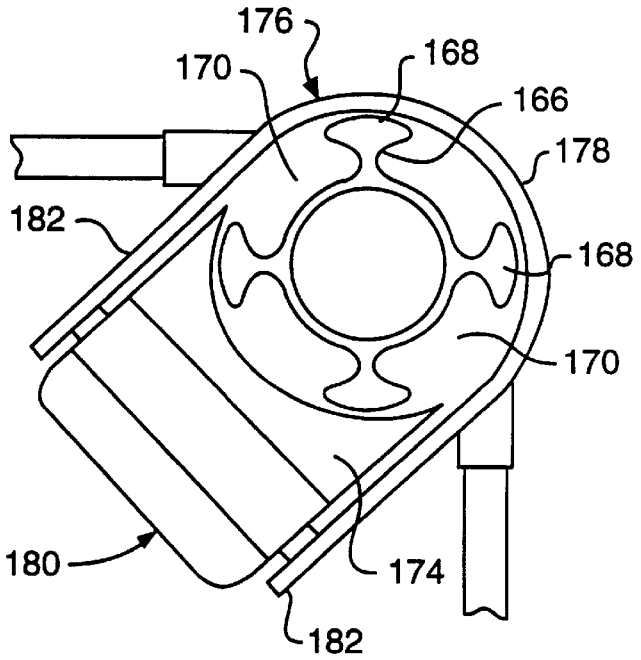
Figure 22:
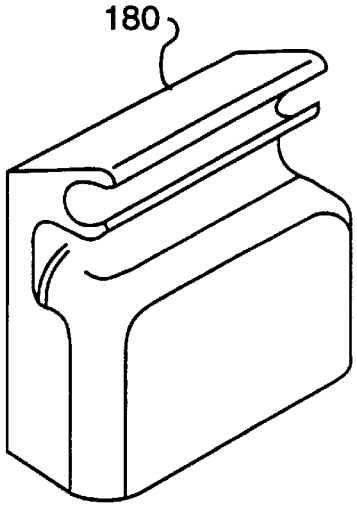
Figure 24:
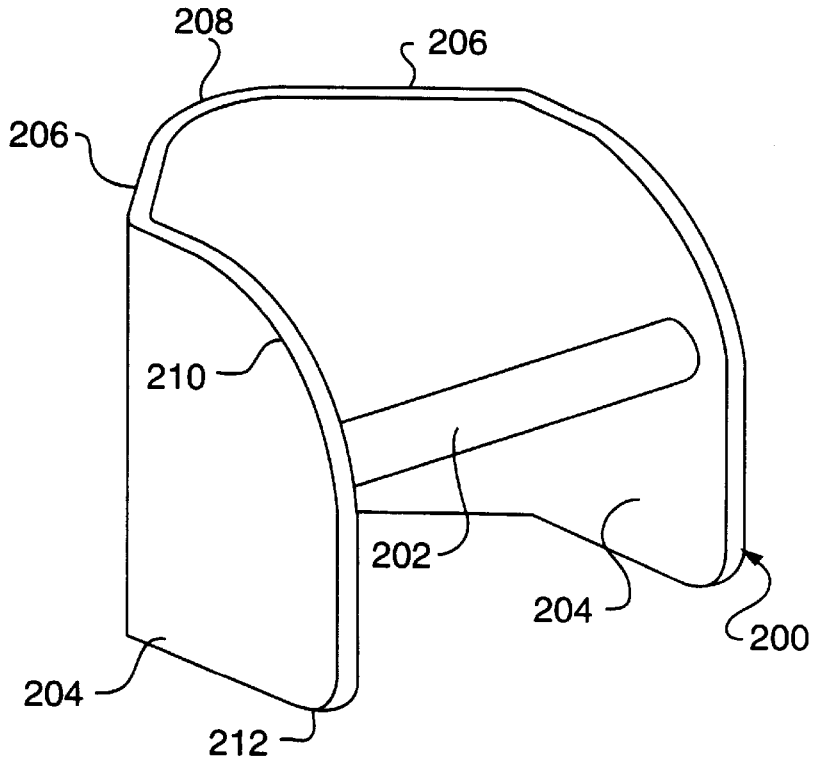
Figure 25:
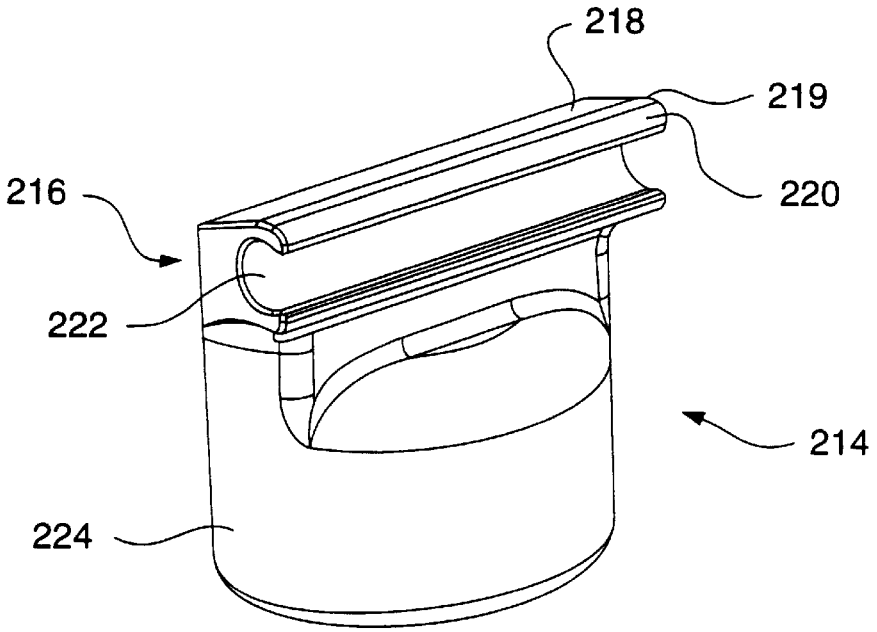
Figure 26:
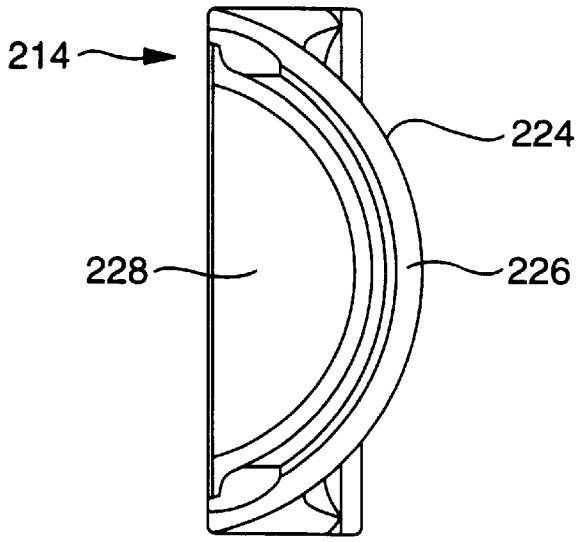
Figure 27:
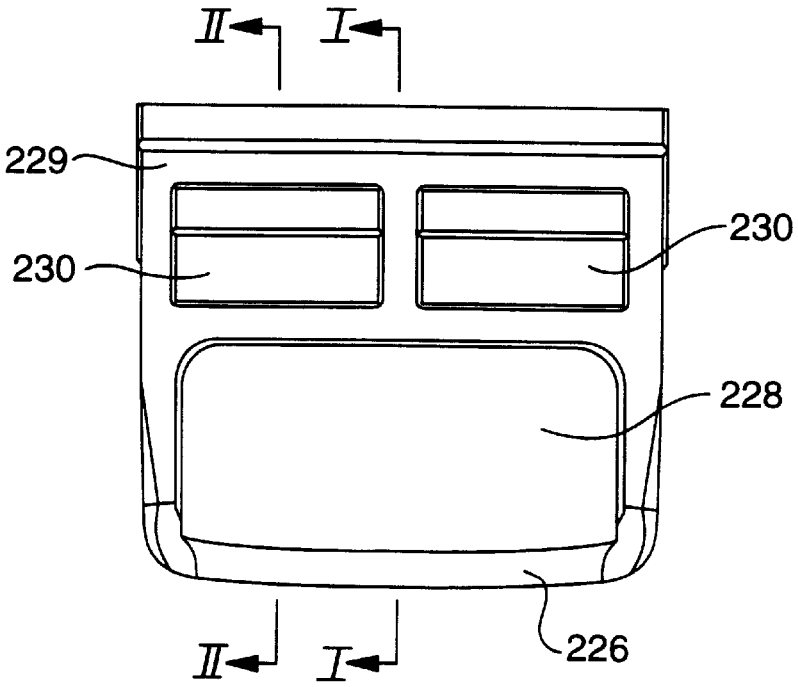
Figure 28:
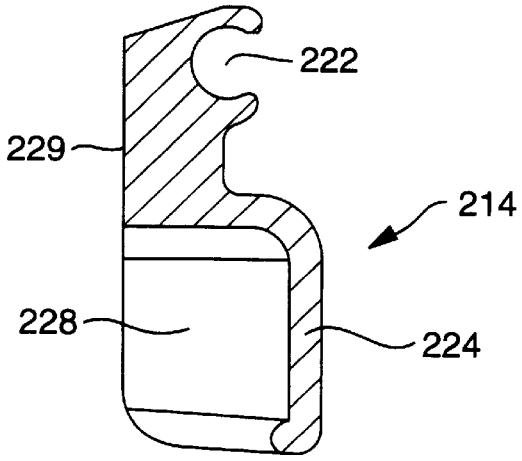
Figure 29:
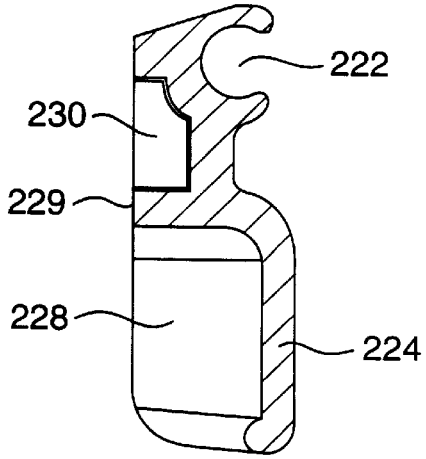
Figure 30:
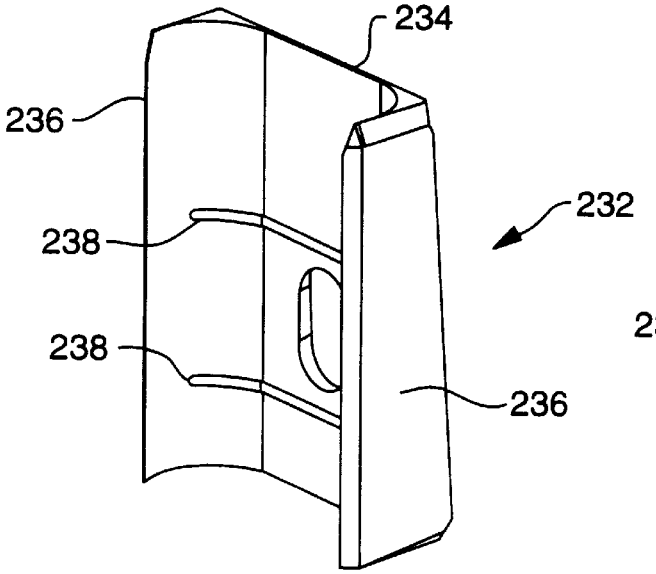
Figure 31:
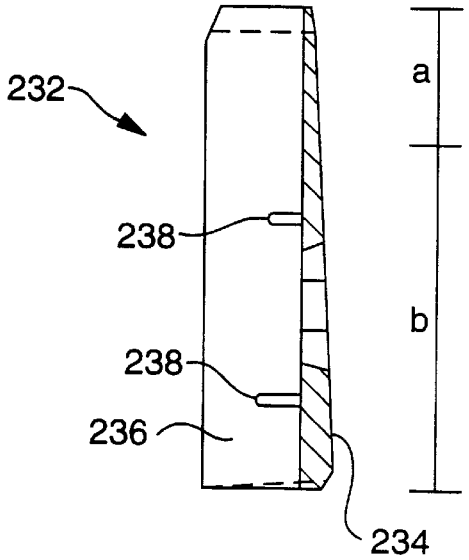
Figure 32:
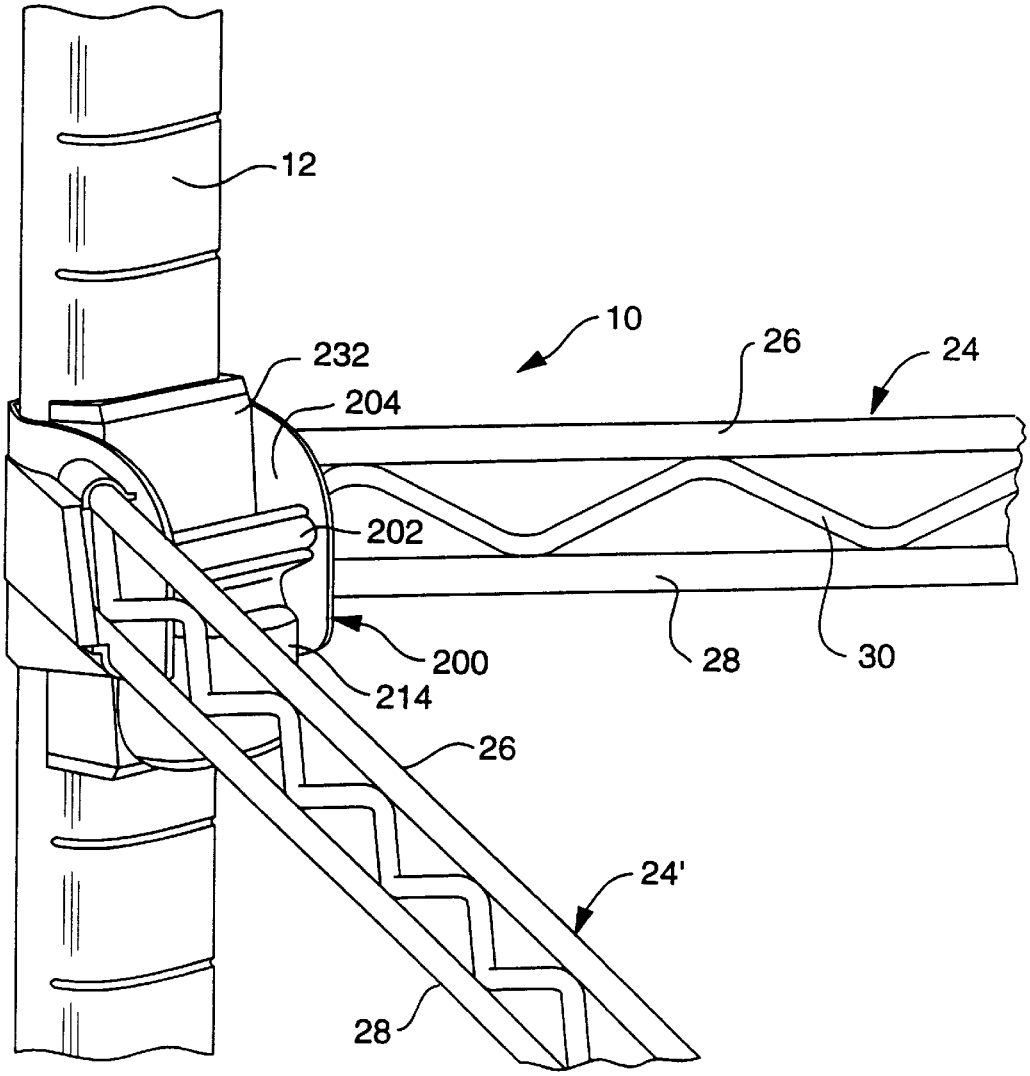
Figure 33:
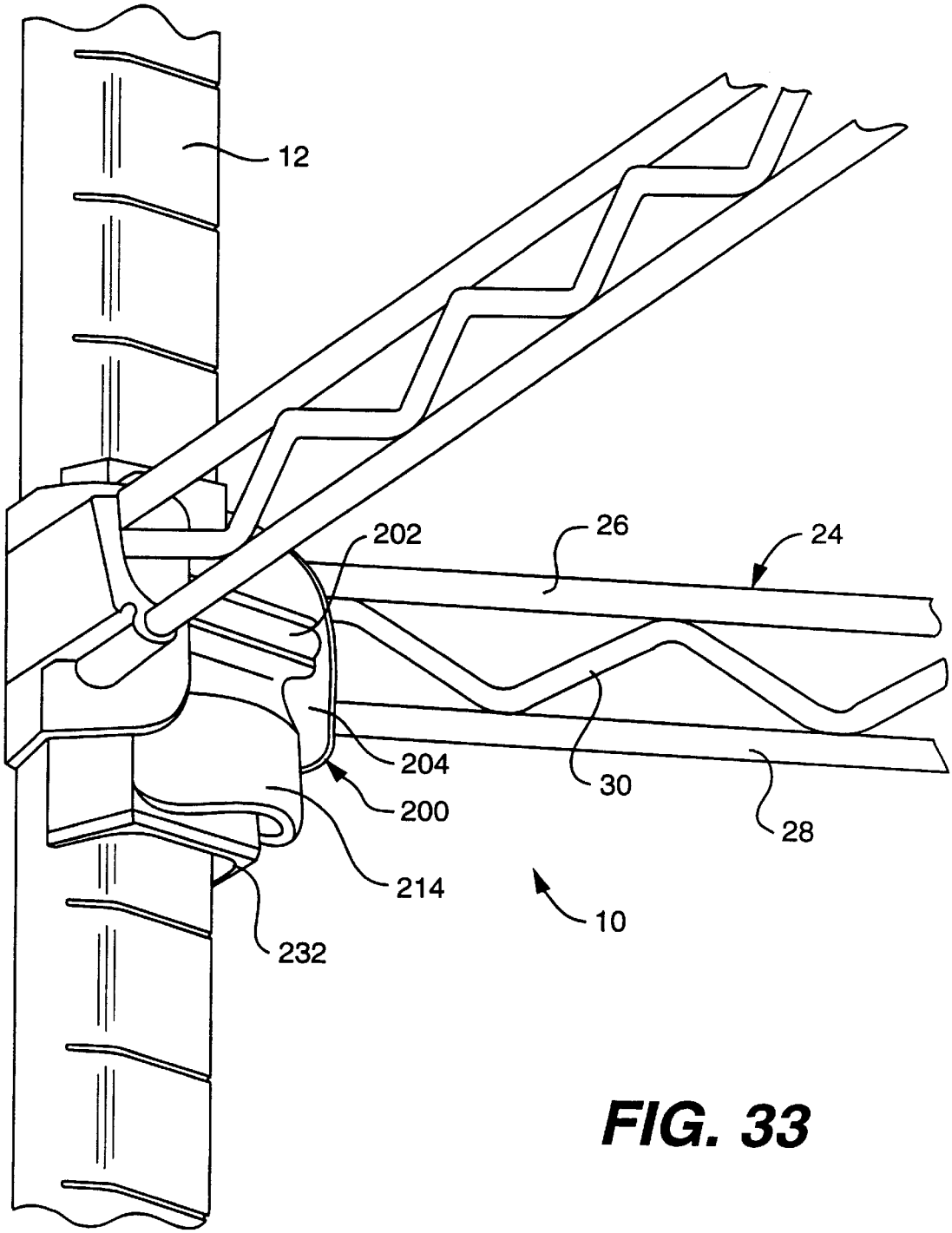

14A is a perspective view of a flipper in accordance with the modified embodiment shown in FIG. 12A;

FIG. 14B is a perspective view of a flipper in accordance with the modified embodiment shown in FIG. 12B;

FIG. 15 is a partial perspective view of a support post and a wedge member in accordance with a third embodiment of the present invention;

FIG. 16 is a top view of a corner of a shelving system in accordance with the third embodiment of the present invention;

FIG. 17 is a perspective view of a flipper in accordance with the third embodiment of the present invention;

FIG. 18 is a partial perspective view of a support post and wedge member in accordance with a modification of the third embodiment of the present invention;

FIG. 19 is a perspective view of a flipper in accordance with the modified third embodiment of the present invention;

FIG. 20 is a partial perspective view of a flanged support post and wedge member in accordance with a fourth embodiment of the present invention;

FIG. 21 is a top view of a corner portion of a shelving system in accordance with the fourth embodiment of the present invention;

FIG. 22 is a perspective view of a flipper in accordance with the fourth embodiment of the present invention;

FIG. 23 is a side elevational view of the support assembly in accordance with the modified embodiment shown in FIG. 12B;

FIG. 24 is a perspective view of a collar in accordance with a fifth embodiment of the present invention;

FIG. 25 is a perspective view of a flipper in accordance with the fifth embodiment of the present invention;

FIG. 26, is a bottom plan view of the flipper shown in FIG. 25;

FIG. 27 is a rear elevational view of the flipper shown in FIG. 25;

FIG. 28 is a cross-sectional view of the flipper taken long lines I—I in FIG. 27;

FIG. 29 is a cross-sectional view of the flipper, taken along lines II—II in FIG. 27;

FIG. 30 is a perspective view of a wedge in accordance with the fifth embodiment of the invention;

FIG. 31 is a side elevational view, partly in cross-section, of the wedge shown in FIG. 30;

FIG. 32 is a perspective view of the support assembly in accordance with the fifth embodiment as viewed from above a wire shelf frame; and FIG. 33 is a perspective view of the support assembly in accordance with the fifth embodiment as viewed from below the wire shelf frame.

DESCRIPTION OF THE PREFERRED EMBODIMENTS

For purposes of explanation only, and to illustrate in part how the present invention may be adapted easily to conventional shelving technology, the support assembly of the present invention will be described below in use with a knock-down shelving system. The shelving system generally includes a plurality of support posts, e.g., four, arranged to support one or more shelves at corner assemblies thereof. Of course, the support assembly of the present invention can be used in various types of support systems, e.g., cabinets, closets, etc., with a shelving system being only one example thereof. Moreover, the support assembly can be used in conjunction with many shelf embodiments and is not limited to use with a corner of a shelf or, for that matter, a corner of any supported member. In the examples given below, the support assembly is structurally associated with a wire shelf frame designed to be fitted with plastic shelf mats. However, the support assembly of the present invention will be readily adaptable to many other shelf embodiments including, but not limited to, a wire shelf or a solid sheet metal shelf.

Figure 1:
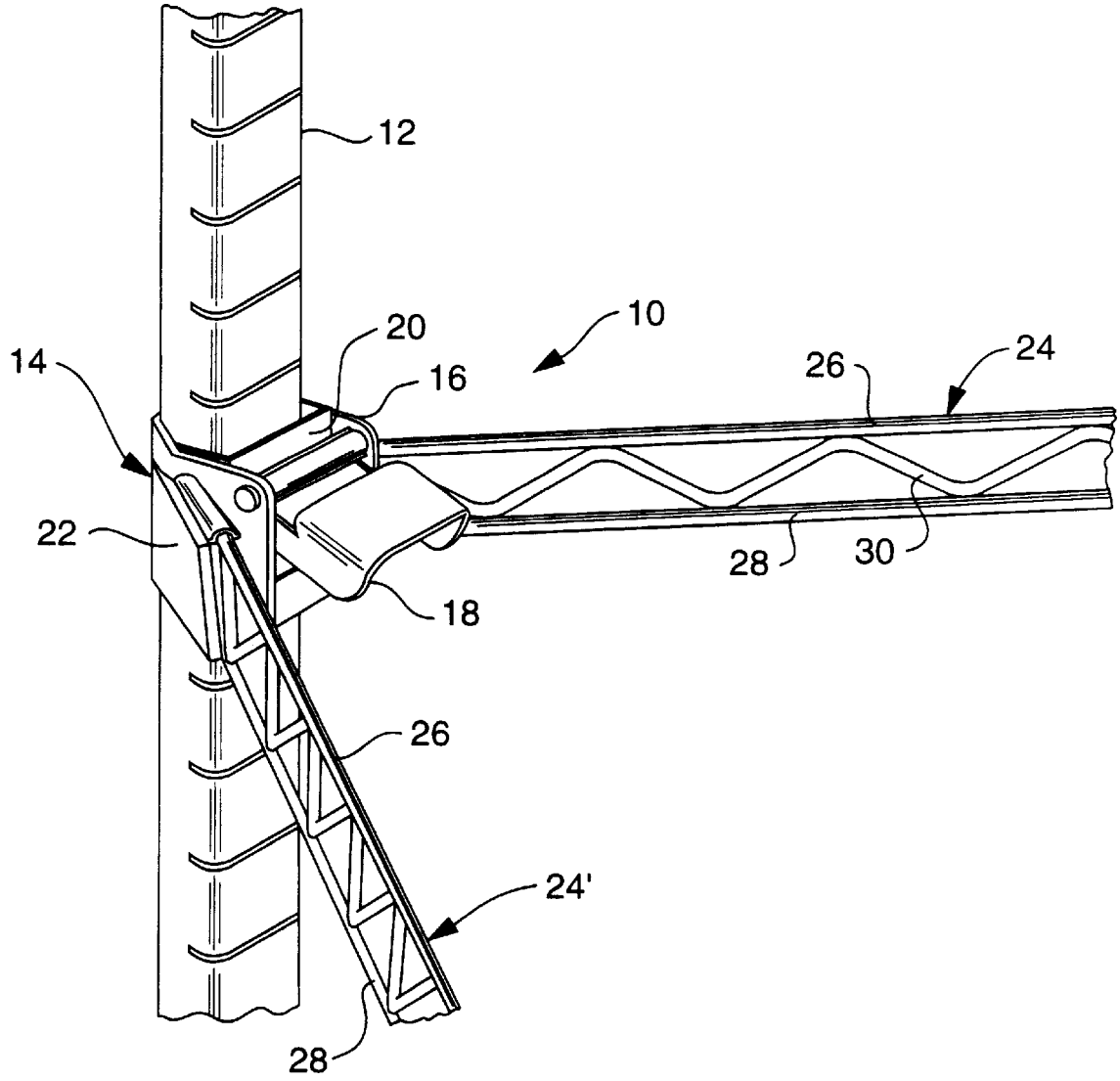
FIG. 1 is a partial perspective view of a shelving system in accordance with a first embodiment of the present invention.

FIG. 1 illustrates one corner of a shelving system utilizing the support assembly in accordance with the present invention. In this figure, a wire shelf frame 10 is positioned on an elongated support post 12 by a corner support assembly 14.

Generally speaking, the corner support assembly 14 is comprised of a collar 16 and a locking mechanism, or flipper, 18 rotatably mounted to the collar. In this view, the flipper is shown in its unlocked position. The corner support assembly is secured between an end outer rail 24 and a side outer rail 24' which form part of the shelf frame 10. A tapered wedge member 20 is positioned on the post where the shelf frame is to be secured. With the flipper in the closed position, the wedge member is compressed against the support post 12, and the corner support assembly 14 surrounds the support post and wedge member like a sleeve and is seated thereon to support the shelf frame with a wedging force.

Although FIG. 1 is a partial view showing only one corner of the shelving system, it will be understood that the shelving system will normally include a plurality of support posts 12 corresponding in number to the number of corner support assemblies 14 in the shelf frame 10. In a typical shelving system, one or more rectangularly-shaped shelf frames will have a corner support assembly in each of four corners.

In this embodiment, the wire shelf frame 10 is part of a modular shelf that is formed by securing the outer rails 24 and 24' to the corner support assemblies 14 by conventional means such as welding. In a rectangular shelf configuration, for example, two end outer rails 24 and two side outer rails 24' will be secured between four corner support assemblies to comprise the wire shelf frame. As illustrated in FIG. 1, each outer rail includes a top rail 26, a bottom rail 28 and a snake-like rail 30 secured between the top and bottom rails for stability. One or more transverse rails (unshown) can be secured between parallel outer rails for additional support and to increase the load-bearing capacity of the shelf.

The preferred material for the collar 16 and the outer rails 24 and 24' is metal, most preferably cold rolled steel or stainless steel. These compositions are relatively light weight, provide high structural rigidity, and are inexpensive to manufacture by known metal forming methods. Further, stainless steel is resistant to corrosion and easily cleaned, so that it may be utilized in many sanitary applications, including food service applications.

Figure 2A:
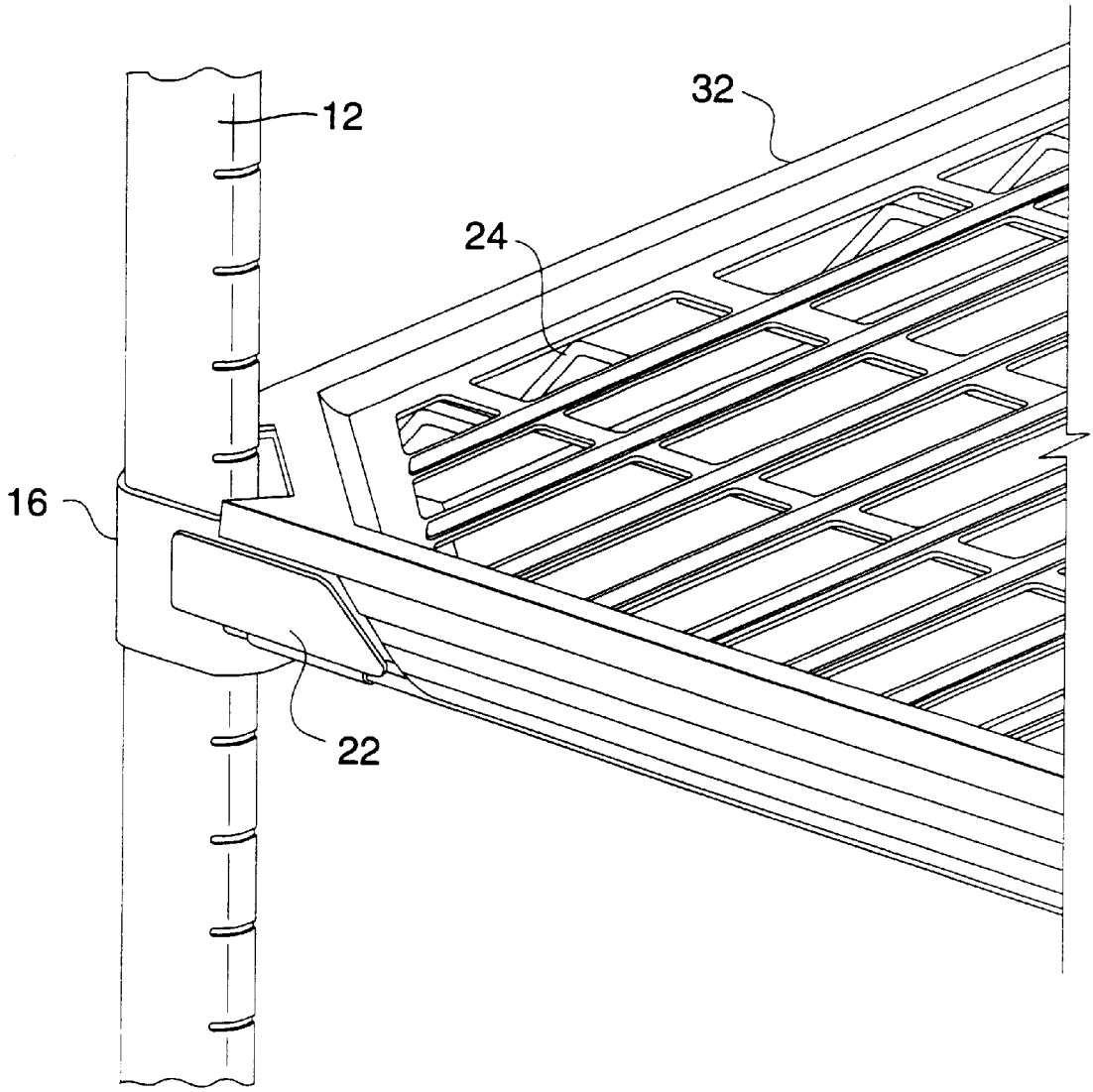
FIG. 2A is a partial perspective view of one corner of the shelving system in accordance with the first embodiment shown in FIG. 1.
Figure 2B:
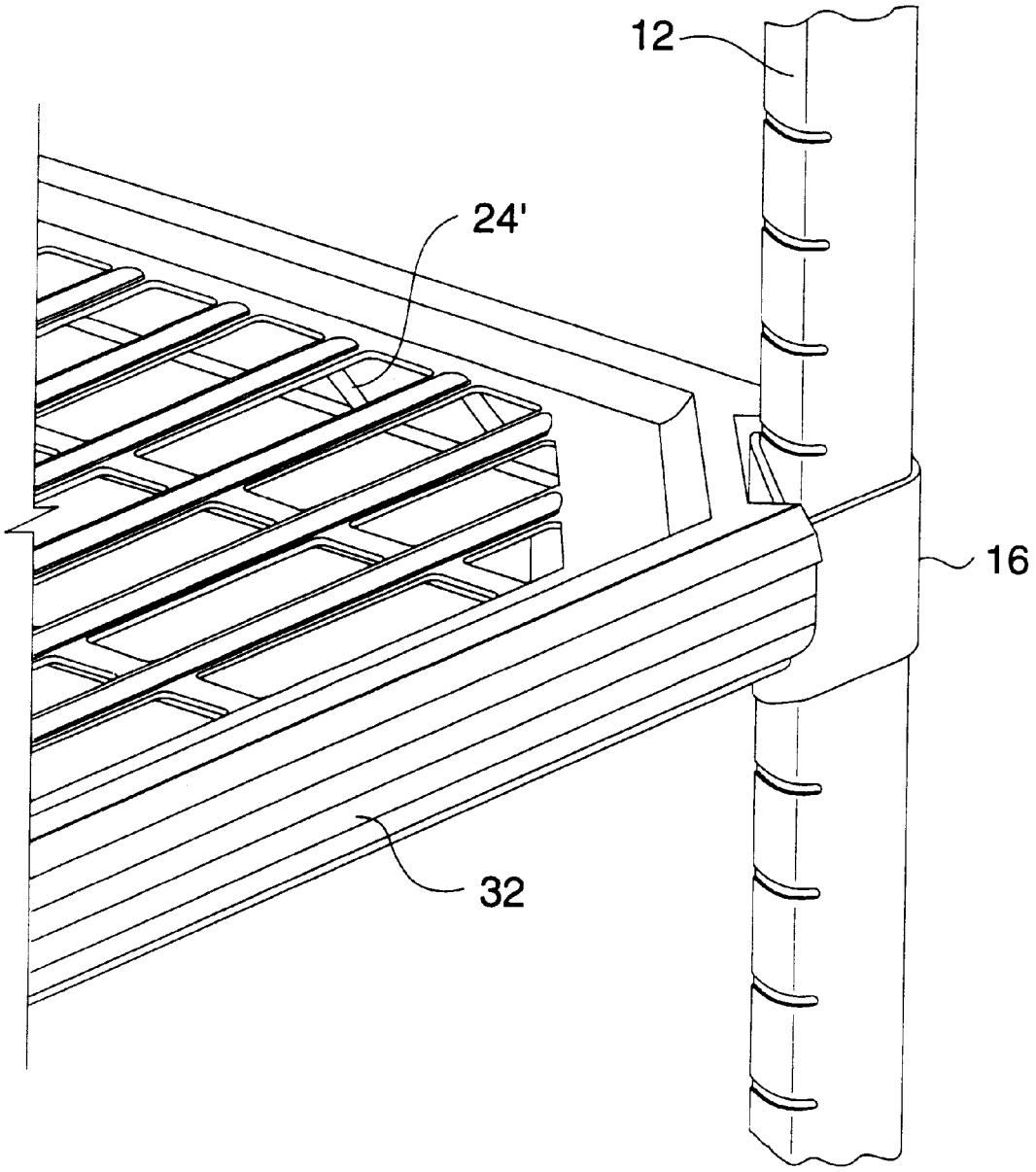
FIG. 2B is a partial perspective view of another corner of the shelving system in accordance with the first embodiment shown in FIG. 1.

With reference to FIG. 2A, the wire shelf frame supports one or more removable shelf mats 32 to complete the modular shelf. The shelf mats are preferably made of a polymer material and can be snap-fit or otherwise friction fit to the wire shelf frame. This allows the shelf mats to be easily removed and cleaned, if desired. FIG. 2A also illustrates shields 22 that can be snap-fit onto the shelf frame at one or both ends of the side outer rail 24' to provide an aesthetically pleasing, finished look. The vertical edges of the shelf mats 32 at the corners are cut away to accommodate the shields 22. The shields are preferably used only on the side outer rails 24', which are normally longer than the end outer rails 24. FIG. 2B is a perspective view of the shelving system looking at one end of the shelf, which is not provided with the shield.

Figure 3:
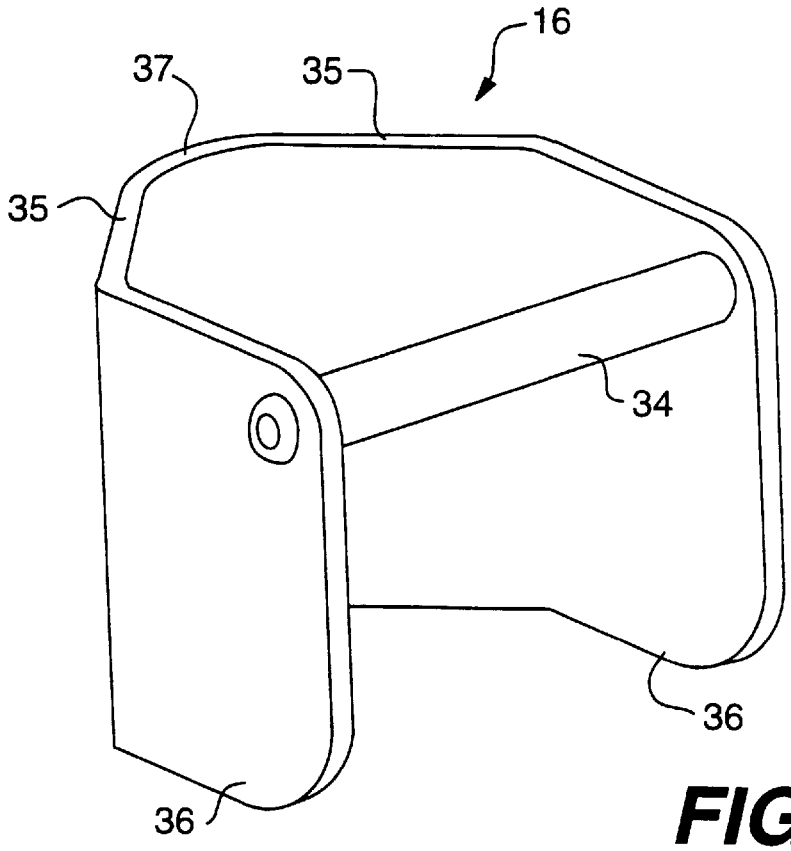
FIG. 3 is a perspective view of a collar in accordance with the first embodiment of the present invention.

An isolated view of the collar 16 is provided in FIG. 3. The collar includes a cylindrical shaft 34, preferably non-rotatable, secured between two lateral sides 36 for rotatably supporting the flipper 18. In accordance with the present invention, a rear section of the collar 16 joining, or connecting, the two lateral sides is contoured to fit the outward-facing shape of the post 12. In this embodiment, the post has a generally triangular cross-section as discussed in detail below. The rear side is thus shaped to have a straight portion 35 angled from each lateral side and joined by a rounded apex 37.

Figure 4:
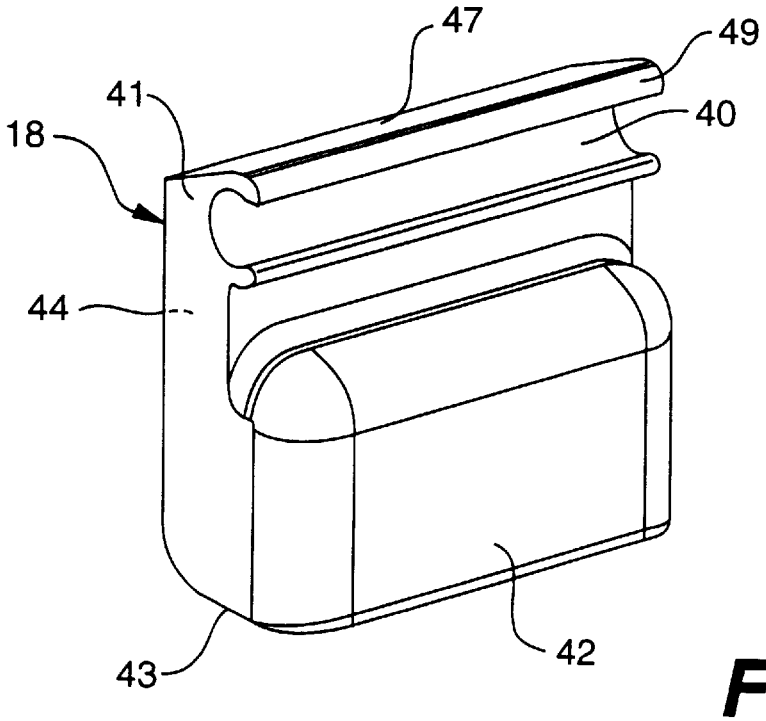
FIG. 4 is a perspective view of a flipper in accordance with the first embodiment of the present invention.

FIG. 4 illustrates the flipper 18 in accordance with a first embodiment of the subject invention. The flipper, which is preferably integrally formed, has an upper end 41 and lower end 43. Further, the top end has a flat portion 47 and a rounded portion 49, with the rounded portion defining part of an open cylindrical cavity 40 for receiving and containing the shaft 34 of the collar 16. The lower end includes a preferably flat manipulating portion 42 for grasping by the user. A rear face 44 of the flipper, which extends at an angle from the flat portion 47 and cannot be seen in FIG. 4, is shaped to complement the shape of the wedge member 20, which in this embodiment is substantially flat. The flipper is mounted on the collar to rotate about a longitudinal axis of the shaft. The preferred material for the flipper is a rigid molded plastic such as, for example, reinforced nylon.

While in this embodiment the cylindrical cavity 40 and shaft 34 interface to rotatably support the flipper on the collar, other means for rotatably supporting the flipper could be provided without departing from the scope of the invention. For example, the flipper could have rounded beads on either end that would sit in complementary-shaped indents on the collar, or conversely, the collar could have the rounded beads which mate with indents on opposite ends of the flipper.

Figure 5:
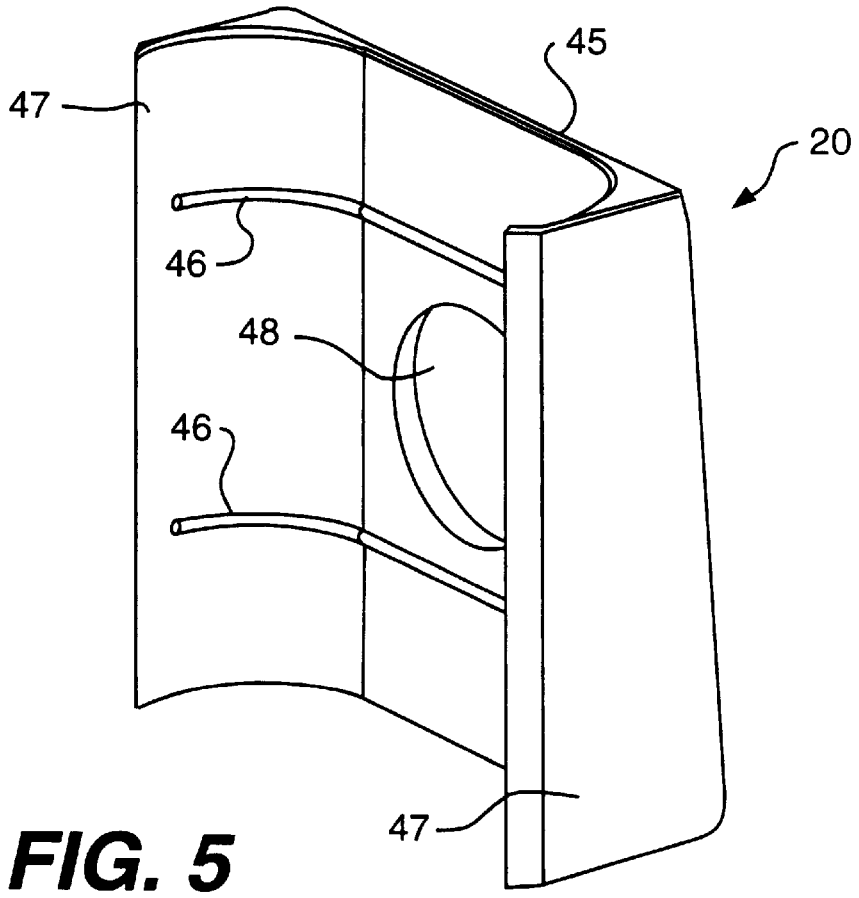
FIG. 5 is a perspective view of a wedge member in accordance with the first embodiment of the present invention.

FIG. 5 shows a wedge member 20 designed to clip onto an interior face of the support post 12. The wedge member includes a front portion 45 flanked by two contoured lips 47 for clipping, or snap-fitting, the wedge member onto the support post. In addition, detent means such as internal beads, or ribs, 46 are provided on the internal surface of the wedge member and are spaced at intervals corresponding to the spacing of grooves on the support post.

The configuration of the internal beads is designed to mate with the configuration of the grooves in the support post. Although two internal beads are shown in the preferred embodiment, the wedge member may comprise one or more internal beads. Further, the number, size and shape of the internal beads may be varied for a number of reasons including, for example, the size of the wedge member 20, the size of the spacing of the grooves in the support posts, and the shelving application. The internal beads provide vertical support when they are seated in the grooves of a support post. To further secure the wedge member on the support posts, additional vertical support is provided by a wedge action as discussed below. It will therefore be appreciated that the wedge member 20 may be clipped on to the support posts at any incremented height, and further may be translated up and down to any other incremented height.

A cut-out 48 can be provided in the front portion 45 to view optional numbers on the support post for vertically aligning the wedge member with wedge members on other support posts.

The outer surface of the front portion is substantially flat in this embodiment to correspond to the substantially flat rear face 44 of the flipper. Although not readily recognizable in FIG. 5, the front portion is also slightly tapered from its upper end to its lower end, such that the lower end is wider and extends toward an interior of the shelving system. In the preferred embodiment, the taper is shallow to maximize rigidity and minimize the thickness of the wedge member. For example, the taper is of the order of 4°. A better view of the tapered shape of the wedge member is provided in FIG. 7A, which will be discussed below.

With the tapered shape of the wedge member, an inwardly directed force is created by the weight of the shelf assembly to provide a wedging action between the corner support assembly and the wedge member. The preferred material for the wedge member is a molded plastic, such as reinforced nylon. Such a molded plastic wedge member can be easily clipped on to and off of the support post. However, other materials which provide the desired characteristics may be used.

Figure 6C:
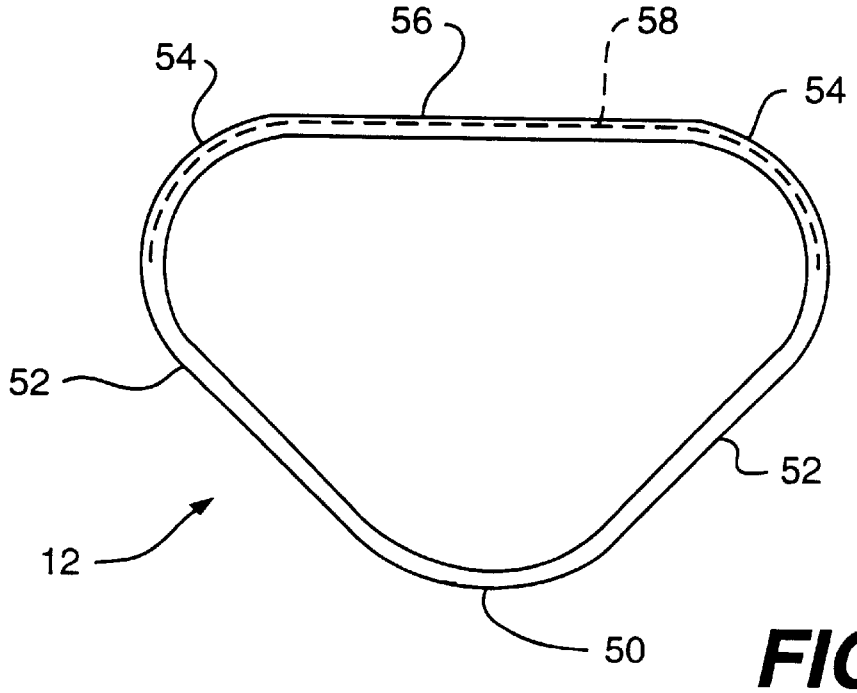
FIG. 6C is a top plan view of the support post shown in FIG. 6A in accordance with the first embodiment of the present invention.
Figure 6A:
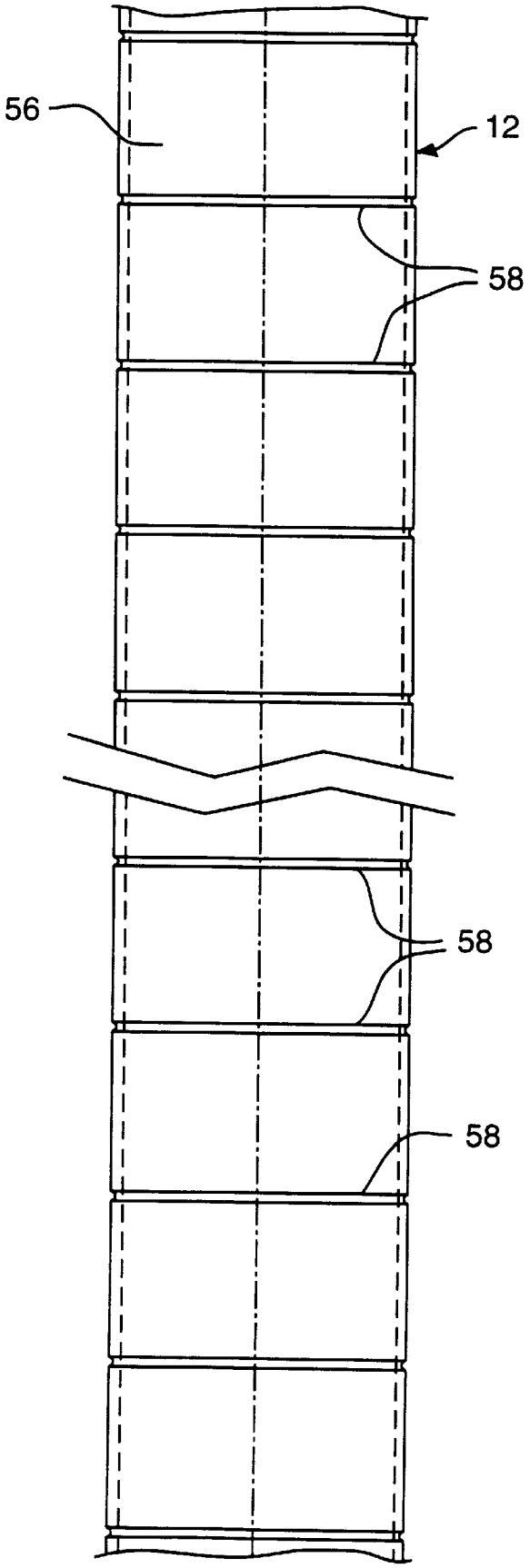
FIG. 6A is a partial front elevational view of a support post in accordance with the first embodiment of the present invention.
Figure 6B:
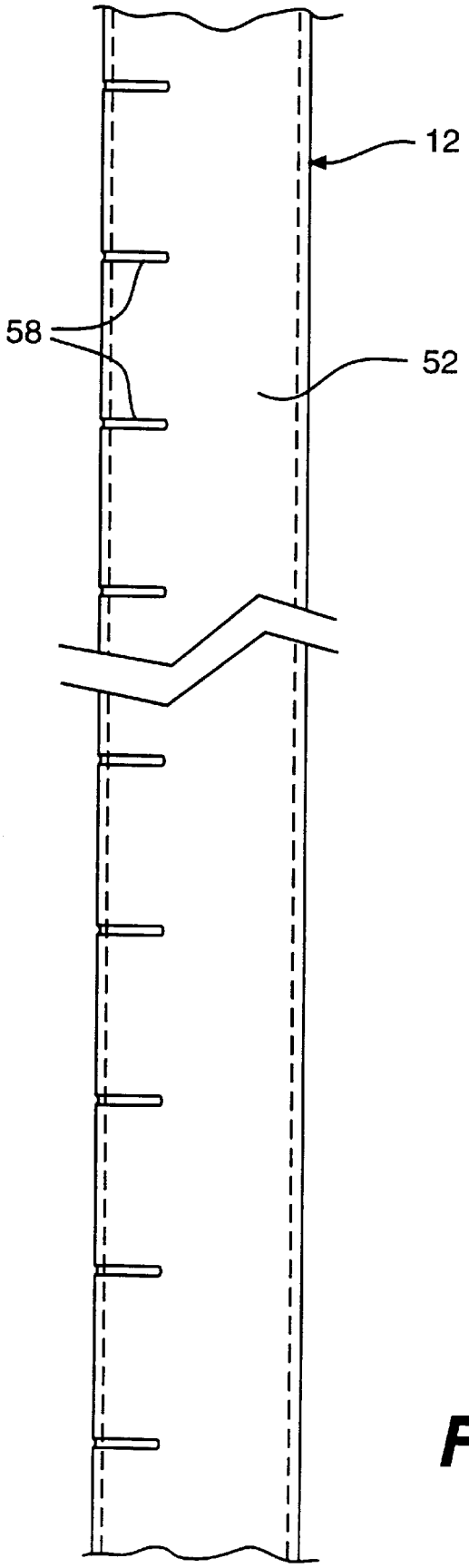
FIG. 6B is a partial side elevational view of the support post shown in FIG. 6A in accordance with the first embodiment of the present invention.

A vertical support post 12 in accordance with this embodiment of the invention is shown in FIGS. 6A, 6B and 6C. As best seen in FIG. 6C, the support post 12 has a generally right equilateral triangular cross-section, which can also be described as a trilobal cross-section. A right-angled apex 50 and two flat exterior sides 52 face the exterior of the shelving system, and interior angled apexes 54 and an interior side 56 of the support post face the interior of the shelving assembly. Accordingly, as explained in detail in U.S. Pat. No. 4,811,670, which is herein incorporated by reference, the triangular geometry of the support post provides multi-directional stability, particularly in the directions of critical stress forces, i.e., in a direction parallel to the edges of the shelf.

The support post includes a plurality of horizontal grooves 58 that are preferably, but not necessarily, evenly spaced in the longitudinal direction of the post. In FIGS. 6A through 6C, the grooves are shown to extend entirely across the interior side 56 of the post and partially across the apexes 54 of the post. Of course, grooves of different lengths could be provided on the support post. The grooves receive the internal beads 46 of the sleeve. As will be appreciated, other comparable detent means for positioning the wedge member to the support post, such as detent tabs and detent steps as disclosed in U.S. Pat. No. 4,811,670, could be used without departing from the scope of the present invention.

Although unshown in the drawings, the top end of each support post 12 can be fitted with an end cap and the bottom end with a caster, a vertically-adjustable foot, an end cap, etc. As one example, the bottom end of the support post can be fitted with a stem receptacle for threadably receiving a leveling leg.

Figure 7A:
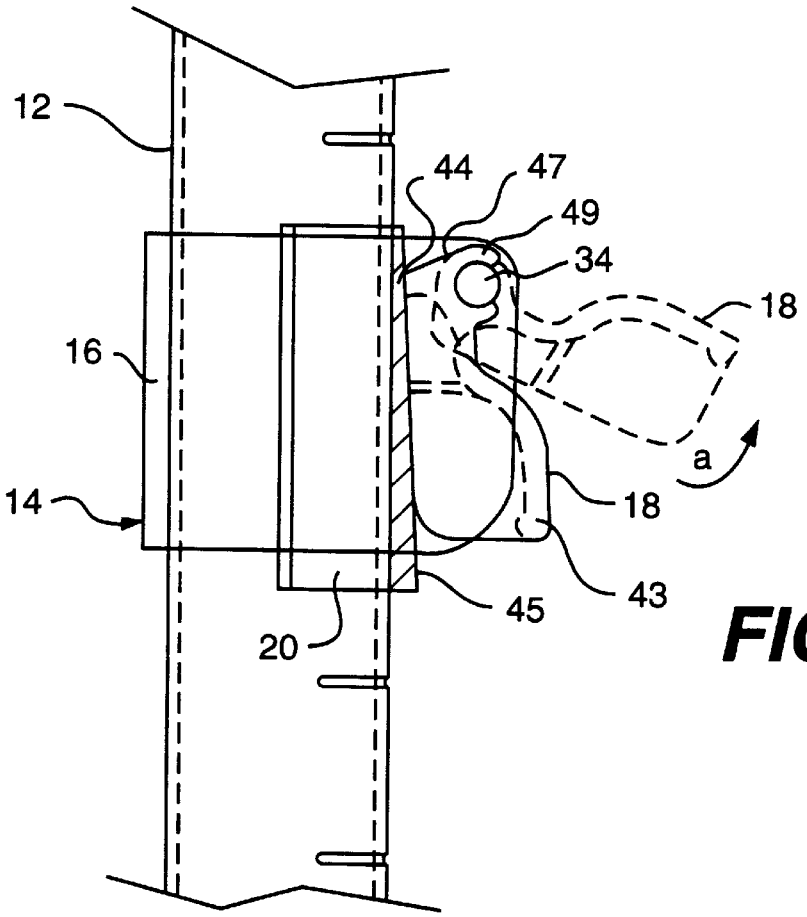
FIG. 7A is a partial side elevational view, partially in cross-section, of the support post and corner assembly in accordance with the first embodiment of the present invention.
Figure 7B:
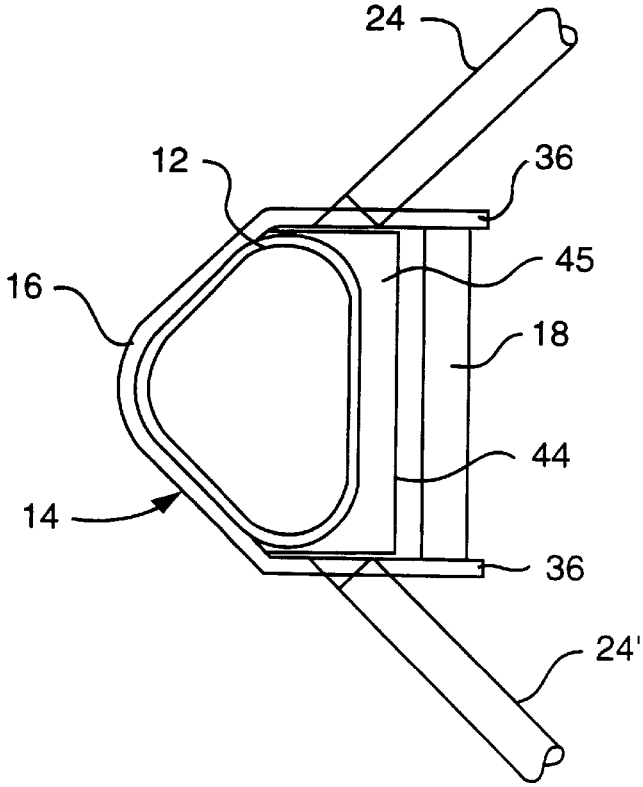
FIG. 7B is a partial top plan view of the support post and corner assembly in accordance with the first embodiment of the present invention.

FIGS. 7A and 7B illustrate how the collar support assembly 14 is secured to the support post 12. For the sake of simplicity, the outer rails 24 and 24' have been deleted in FIG. 7A but are shown to be secured to the lateral sides 36 of the collar 16 in FIG. 7B. When the wedge member 20 is mounted on the support post 12 at the desired height, the corner support assembly 14 is positioned over the wedge member and the support post. In this regard, the collar 16 and flipper 18 together form a sleeve that fits over the wedge member and the support post. When the flipper 18 is in the closed, or locked, position as shown in solid lines in FIG. 7A, the rear face 44 of the flipper directs an inward radial compression force against the wedge member 20, in which the front portion 45 is cross-hatched for clarity. In addition, the tapered shape of the wedge creates a wedge action between the wedge member and the flipper for supporting the shelf assembly. It will be appreciated that the greater the weight on the shelf, the greater the downward force and thus the greater the wedging force.

FIG. 7A will also be referred to in discussing two salient features of the present invention. The first feature relates to the ability of the flipper to easily and quickly release the wedging action between the corner support assembly and the wedge member. This frees the shelf to slide up or down the support posts. To release the wedging action, the closed flipper 18 is rotated in the counter-clockwise direction of arrow a to its unlocked position as represented by the dashed lines. By pivoting the flipper about the shaft 38 in this manner, the compression force between the flipper 18 and the wedge member is released. Actuation of the flipper by the user thus allows for quick and reliable releasing of the wedging action.

Another salient feature of the invention is directed to the ability of the flipper to allow the corner support assembly to slide over the support post and mounted wedge member (or members). At rest, the flipper 18 normally hangs, by gravity, in substantially the same position shown in solid lines in FIG. 7A, i.e., with the lower end 43 directed downwardly. Now, with the flipper in this position and the corner support assembly disposed below a wedge member mounted on the support post, when the shelf is raised toward the wedge member the lower (and wider) end of the wedge member will initially contact the flat portion 47 of the upper end of the flipper, causing it to rotate counter-clockwise about the shaft 34 in the direction of arrow a. This action raises the flipper toward its unlocked position, whereby the rounded portion 49 of the upper end is substantially opposite the wedge member. As the flipper is biased toward its unlocked position, the contour of the upper end allows the flipper to pass completely over the wedge member.

The ability of the flipper to be rotated automatically by the wedge member allows the support assembly to be easily raised up the support post. As will be appreciated, when the support assembly is raised over a series of wedge members spaced apart on the support post, the flipper will rotate automatically as described above as it passes over each wedge member and, as it clears the wedge member, rotate in the opposite direction back to its at-rest position. However, this action of the flipper takes place in only one direction, i.e., raising of the support assembly 14 relative to the support post, and in that sense can be described as a ratchet-like movement. When the support assembly slides along the support post in the opposite direction, i.e., downward toward a mounted wedge member, the rear face 44 of the flipper mates with the front portion 45 of the wedge member and creates a wedging action. Of course, if the flipper is held in its raised, or unlocked position, the flipper will clear the wedge member and the support assembly can slide downward over the support post and mounted wedge member(s).

The ability of the corner support assembly to translate relative to wedge member mounted on the support post and slide completely thereover enables both the assembly of a shelving system and an adjustment of the height of the shelves to be accomplished with ease. To adjust the height of an individual shelf, for example, a second set of wedge members can be clipped on to the support posts at the desired new height. The flippers at the corner support assemblies are then rotated to the unlocked position, releasing the compression force applied to the wedge members by the flippers and allowing the shelf to be raised or lowered. To raise the height of the shelf, the shelf is raised along the support posts to allow the flippers to pass over the second set of wedge members in the manner described above. Once the flippers clear the wedge members (such that the flipper can rotate back to its at-rest position), the shelf can be lowered, whereby the flippers will seat on their respective wedge members to create the desired wedging force. The first set of wedge members can then be removed from the support posts if desired.

It will be appreciated that with this arrangement that allows the flippers to freely rotate, the flippers "self-regulate" themselves as they return to the at rest position to match the slope of the wedge member. The flippers thus automatically come to rest against a respective wedge member regardless of the slope of the wedge member to create the necessary wedging force.

To assemble a shelving system with a plurality of shelves utilizing the corner support assembly of the present invention, the shelves can be stacked on the floor one atop the other. One set of wedge members for each shelf is positioned on the support posts at the desired shelf heights, and then the support posts are inserted in the aligned corner support assemblies of the shelves. Each shelf can then be raised, one-by-one, over the sets of wedge members provided for lower shelves and then over its designated set of wedge members positioned at the desired height. As the shelf passes over the designated wedge members, it is lowered back thereon to allow the flippers, which fall back to the at-rest position once the wedge members are cleared, to engage and seat against the wedge members to create a wedging force for supporting the shelf.

This static system of supporting the shelves, i.e., securing the shelves directly to the support posts, allows for significant load-bearing capacity while providing an easy to assemble and easy to adjust support system.

Figure 8A:
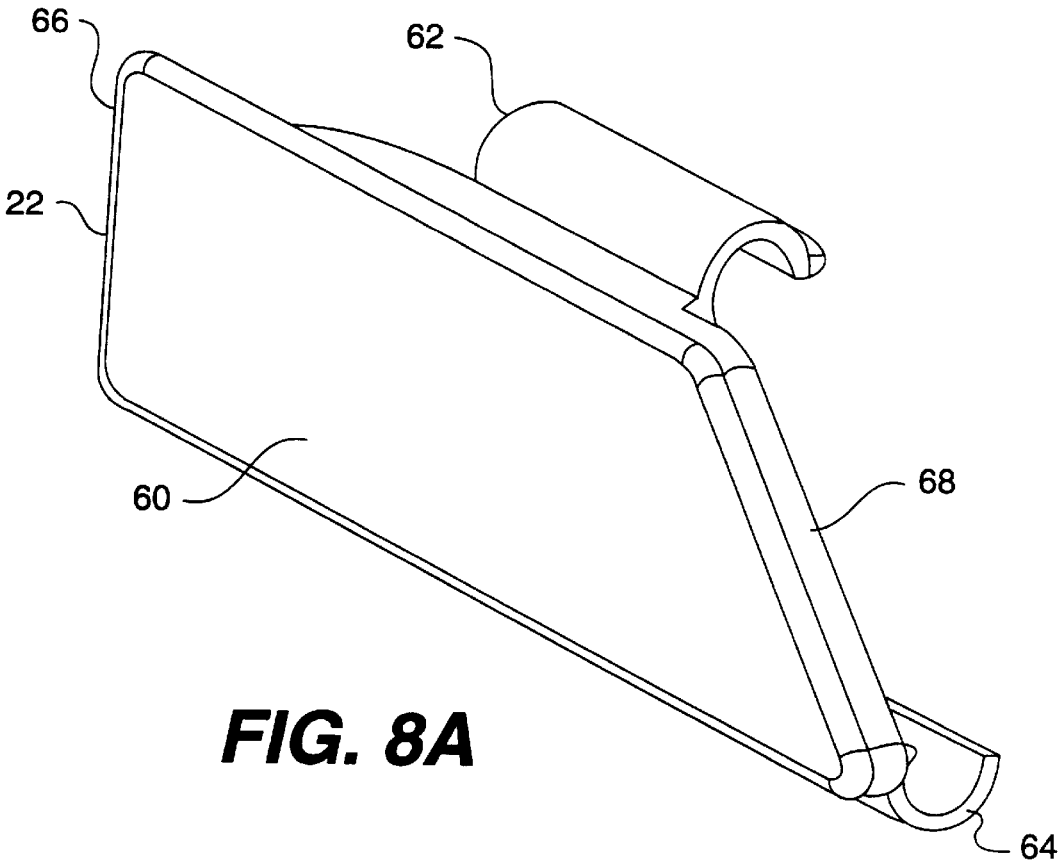
FIGS. 8A and 8B are perspective views of a left-hand shield in accordance with the present invention.
Figure 8B:
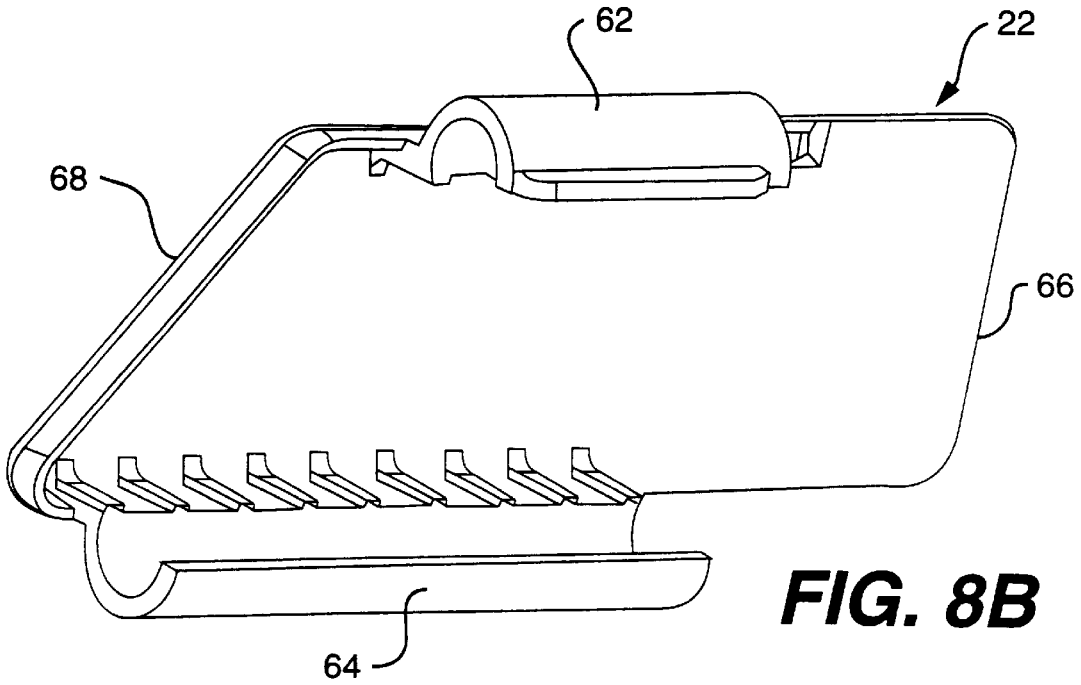

With respect to the shields 22 which may be fitted to the shelf assembly, isolated front and rear views of a left-side shield 22 are provided in FIGS. 8A and 8B, respectively. The shield is preferably formed of a molded plastic having the resiliency necessary to be snap-fit over the outer rails. In FIG. 8A, the shield 22 is shown to have a substantially flat front face 60 and upper and lower rounded forms, 62 and 64, for snap-fitting onto the outer rails 24'. The front face is also defined by one vertical edge 66 and one angled edge 68. As better seen in FIG. 8B, the upper and lower forms have a substantially semi-circular cross-section and sufficient length to define an extended cylindrical cavity. When in position, the upper form 62 snap-fits over the top rail 26 and the lower form 64 snap-fits over the bottom rail 28. Although unshown in the drawin g, a right-hand shield is shaped in substantially the same way as the left-hand shield, except that the vertical edge and the angled edge are reversed.

While the support system of the present invention has been described above in use with substantially triangular-shaped support posts, support posts of other shapes can be used without departing from the scope of the invention. It will be appreciated that the underlying principals of the invention can be used to provide a collar that is contoured to fit around a support post of many shapes and fitted with a rotatable flipper also contoured to complement the outer surface of a wedge member secured to the support post. The wedge member, as well, can be readily adapted to fit support posts of various shapes. The second, third and fourth embodiments described below will better illustrate the ability of the support system of the present invention to be used with different types of support posts.

Figure 9:
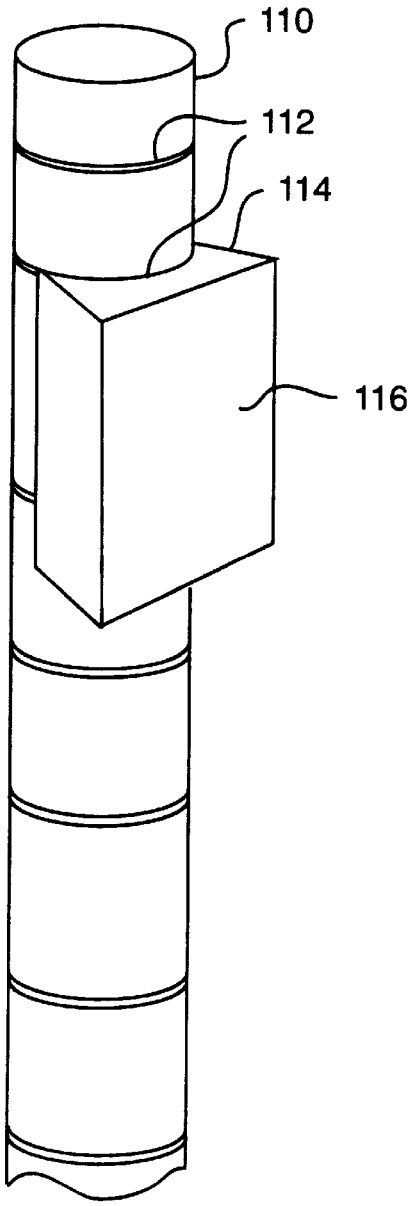
FIG. 9 is a partial perspective view of a support post and wedge member in accordance with a second embodiment of the present invention.
Figure 10:
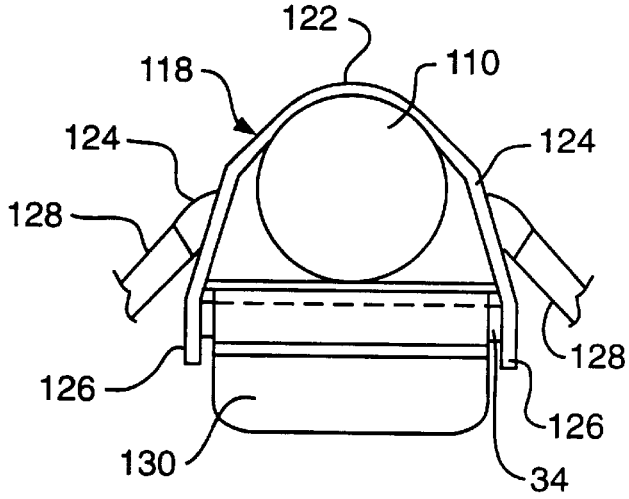
FIG. 10 is a top view of a corner of a shelving system in accordance with the second embodiment of the present invention.
Figure 11:
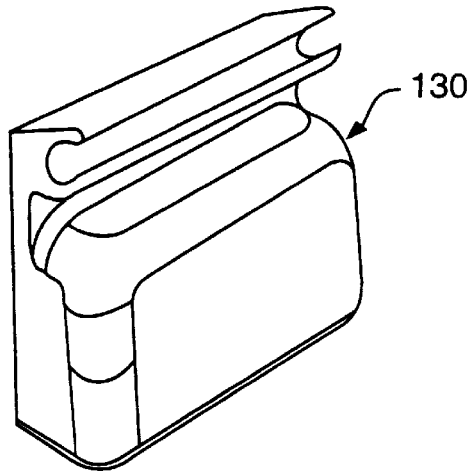
FIG. 11 is a perspective view of a flipper in accordance with the second embodiment of the present invention.

The second embodiment illustrated in FIGS. 9 through 11 shows a support system of the present invention in use with a cylindrical support post. The cylindrical post 110 includes annular grooves 112 for receiving and positioning a wedge member 114 in substantially the same manner described above in the first embodiment, i.e., by using detent means comprised of the annular grooves 112 and complementary beads on the interior surface of the wedge member 114. Of course, the interior surface of the wedge member will be arcuate in shape to complement the surface of the cylindrical support post. The outer surface 116 of the wedge member is substantially flat in FIG. 9. As in the first embodiment, the wedge member is tapered to provide a slightly thicker, lower portion extending toward the interior of the shelving system.

A collar 118 shown in FIG. 10 has a different contour than the collar disclosed in the first embodiment in order to accommodate the shape of the support post. In this second embodiment, an apex 122 of the collar is more rounded to fit the cylindrical support post. Rear sides 124 join the lateral sides 126 of the collar to the apex. With this configuration, outer rails 128 of the wire shelf frame are preferably, but not necessarily, secured to the rear sides 124 of the collar. A flipper 130 of substantially the same shape and characteristics as in the first embodiment is rotatably secured on a shaft 34 extending between the lateral sides 126 of the collar. As in the first embodiment, the rear face of the flipper is substantially flat to complement to outer surface 116 of the wedge member.

Figure 13A:
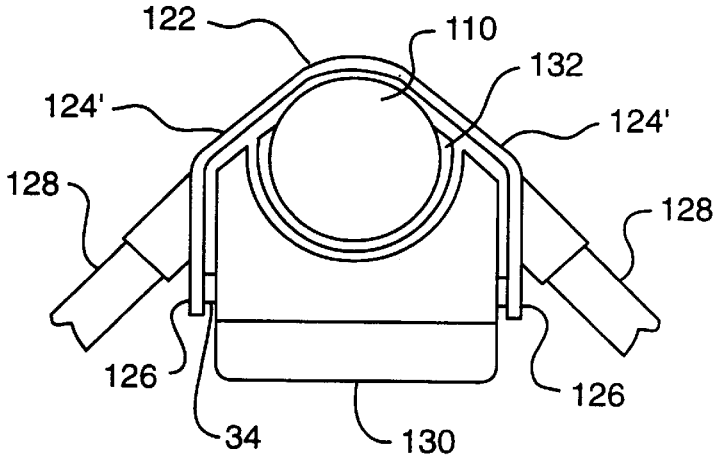
FIG. 13A is a top view of a corner of a shelving system in accordance with the modified embodiment shown in FIG. 12A.

In a first modified version of the second embodiment, shown in FIGS. 12A, 13A and 14A, the outer surface of the wedge member is altered. With reference to FIG. 12A, a wedge member 132 having an arcuate outer surface 134 instead of a flat surface is employed. This modified wedge member fits the support post like a sleeve. The same or comparable detent means as discussed above can be used to secure the wedge member to the support post 110. An optional tab could extend from one or both lateral edges of the wedge member for additional support.

To accommodate for the rounded wedge member, rear sides 124' of the collar 116 are modified as shown in FIG. 13A to fit the contour of the wedge member 132. In this modification, the outer rails 128 are secured to the lateral sides of the collar 126. In addition, the rear face of the flipper 130 is cut out to form a semicircular cavity 138 for engaging the wedge member. The modified complementary shapes of the wedge member and the flipper create a wedging action sufficient to support a shelf when the flipper closes to compress the wedge member, which is still tapered in the manner described above.

Another modification of the second embodiment is shown in FIGS. 12B, 13B, 14B and 23. This modification features a two-piece interlocking sleeve 135 of type used in the SUPER ERECTA SHELF shelving system described above. In that regard, the sleeve 135 is comprised of first and second halves, 137 and 139, respectively, that are snap-fit around the support post and secured to each other by, for example, a tongue and groove arrangement. The sleeve includes one or more ribs (unshown) on its interior surface for engaging an equal number of grooves on the support post. The sleeve also has a frusto-conically-shaped outer surface, which is widest at the bottom.

To accommodate for the frusto-conical shape of the sleeve, a collar 123 will be provided with a rear section 125 that slopes outwardly from top to bottom to complement the slope of the sleeve. The slight slope of the collar 123 is best seen in FIG. 23. The top view of the support assembly in FIG. 13B also illustrates this aspect of the invention. The flipper 130 is substantially identical to the flipper illustrated in FIG. 14A and discussed above, and likewise creates a wedging force when closed to compress the sleeve.

A third embodiment of the present invention is shown in FIGS. 15 through 17. This embodiment features use of a square support post 140 with circumferential grooves 142 equally-spaced in the longitudinal direction. In keeping with the shape of the support post, an inner surface of wedge member 144 has a right-angled V-shaped cut-out for receiving a corner of the support post. Other aspects of the wedge member are the same as in embodiments 1 and 2 described above, i.e., the wedge member includes detent means for mating with the support post and has a tapered outer surface 145.

FIG. 16 shows a collar 146 with a right-angled rear side 148 to complement the outer corner of the support post. Outer rails 150 of the shelf frame are preferably secured to lateral sides 152 of the collar in this embodiment. Substantially the same flipper 154 as disclosed in the first and second embodiments is rotatably mounted on a shaft between the lateral sides 152 of the collar in the same manner described above. The outer surface of the wedge member and the rear face of the flipper are complementary-shaped to mate with each other, and in the illustrated example are both substantially flat.

In a modification of the third embodiment, tapered wedge member 144' can be formed with a right-angled outer surface as shown in FIG. 18. To accommodate for this modification, flipper member 154' has a right-angled cut-out 156 in its rear face as shown in FIG. 19 to complement the shape of the wedge member, which is tapered as described above. The modified flipper is thus able to compress the wedge member in the same manner described above to create a wedging force for supporting a shelf.

In the fourth embodiment, the support system of the present invention is used in conjunction with a flanged support post 160 as shown in FIG. 20. The flanged support post itself is the subject of U.S. application Ser. No. 08/426,674, and is formed to have an interior post 162 with a plurality of radially extending flanges 164 spaced equally about its circumference. With reference to FIGS. 20 and 21, each flange includes a first portion 166 extending radially from the interior post and a second portion 168 transverse to the first portion and having an arcuate outer periphery. Longitudinal slots 170 are formed between each adjacent pair of flanges 164. Lateral circumferential grooves 172 can also be formed on each flange and evenly spaced in the longitudinal direction.

A tapered wedge member 174 can be secured to the support post by the same or comparable detent means used to secure the wedge members in the above-described embodiments. Alternatively, the wedge member could be secured to the flanged support post by interacting with the longitudinal slots 170. The collar 176 shown in FIG. 21 has a rounded back section 178 contoured to fit around the circumference of the flanged support post. As in the other embodiments, a flipper 180 is rotatably secured between lateral sides 182 of the collar for compressing the wedge member.

A fifth embodiment of present invention is shown in various isolated views in FIGS. 24 through 31 and in an assembled state in FIGS. 32 and 33. This embodiment generally features modified versions of several elements disclosed initially in connection with the first embodiment of the invention. More particularly, modifications of a collar and a flipper (collectively a corner support assembly) and of a tapered wedge member are disclosed below.

The modified elements are designed for use with a triangular support post 12 as shown in FIGS. 6A through 6C, as in the first disclosed embodiment. As will be appreciated, however, the following modifications are readily adapted to corner support assemblies and wedges designed for use with support posts of other shapes, including but not limited to the shapes disclosed in the second, third and fourth embodiments.

A collar 200 of the fifth embodiment is illustrated in FIGS. 24 and 25. As in the first embodiment, the collar includes a cylindrical shaft 202, preferably non-rotatable, secured between two lateral sides 204 for rotatably supporting a flipper. A rear section of the collar connecting the two lateral sides is contoured to fit the outward facing shape of the support post. With the post having a generally triangular cross-section in this embodiment as discussed above, the rear section is thus shaped to have straight portions 206 angled from each lateral side and joined by a rounded apex 208.

In this embodiment, the shaft 202 is secured at substantially the vertical center, or a middle portion, of the collar as shown in FIG. 24. In addition, a top portion 210 of the collar has a larger radius than the collar shown in FIG. 3. For example, in one embodiment the radius of the top portion 210 in FIG. 24 is 0.875" and the radius of a lower portion 212 of the collar is 0.250".

A flipper 214 in accordance with this embodiment is shown in FIGS. 25 through 29. The perspective view of FIG. 25 shows the flipper 214 to include, at its top end 216, a flat portion 218 and a rounded portion 220. In addition, a preferably flat transition portion 219 exists between the flat and rounded portions. An open cylindrical cavity 222 receives and contains the shaft 202 of the collar. As will be appreciated, the top end 216 of the flipper is substantially the same as the top end of the flipper disclosed in the first embodiment.

The primary difference of the flipper in this embodiment is that its bottom end 224 is rounded instead of flat like the flipper shown in FIG. 4. As best seen in FIGS. 25 and 26, the rounded bottom end 224 also includes a rounded bottom edge 226. As in the first embodiment, the bottom edge is preferably chamfered. The rounding of this portion of the flipper provides a semi-circular cavity 228 in which the fingers of the user can comfortably rest when opening the flipper. Rounding the bottom end 224 also makes the flipper less susceptible to being accidentally opened by movement of articles on the shelf below.

As in the first embodiment, a rear face 229 of the flipper is substantially flat to complement the shape of the wedge member. As shown in FIGS. 27 and 29, however, the rear face 228 can include pockets 230 to aid in molding.

A wedge member 232 in this embodiment is substantially the same wedge member shown in FIG. 5, but with a greater body length. As in the first embodiment, the wedge member 232 in FIG. 30 includes a front portion 234 flanked by two contoured lips 236 for clipping, or snap-fitting, the wedge member onto the support post. Internal beads, or ribs, 238 are provided on the internal surface of the wedge member and are spaced at intervals corresponding to the spacing of grooves on the support post, as in the first embodiment.

The cross-sectional view of FIG. 31 illustrates the extra body length of the wedge member in this embodiment. The extra body length a, in this example 0.625", is added to the top portion of the wedge member 232, making its total length 2.625". As seen in this figure, the extra body length a is not tapered as is the remaining length b of the wedge member. As illustrated, the lower end is wider than the upper end so as to extend toward an interior end of the shelving system. In this embodiment, the taper is of the order of 4°.

As demonstrated in FIGS. 32 and 33, the collar, the flipper and the wedge member of this embodiment work together in the same manner disclosed in the first embodiment to securely support a shelf wire frame 10 on the support posts. In this embodiment, however, moving the shaft 202 to the center, or middle portion, of the collar serves to more evenly distribute the stress on the top and bottom rails, 26 and 28, of the wire shelf frame 10 where they are secured (such as by welding) to the collar 200. With this arrangement, the shelf sits a little higher up on the support assembly than in the first embodiment, and the longer wedge makes it easier to reduce or even eliminate the space between a corner of a shelf mat and the support post, which can trap dirt, food particles or other undesirable items.

As the foregoing description of the preferred embodiments describes, an advantage of the present invention is that it allows a user to quickly and easily change the height of the supported item, e.g., a shelf, to accommodate a variety of shelving applications. Moreover, since the support system allows the shelf frame to slide over the wedge member mounted on the support posts, height adjustment is easy and can be done without tools or without having to remove adjacent shelves.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A support system, comprising:

a support post;

a wedge member, having a tapered portion, located on said support post; and support means for adjustably supporting a member to said support post, said support means including a locking mechanism movable between a first position for press-fitting said wedge member against said support post and a second position for releasing the press-fitting, said locking mechanism having a surface that abuts said wedge member when in the first position thereby to effect said press-fitting and that is released from said wedge member when moved to said second position to release said press-fitting.

2. A support system according to claim 1, wherein said support means comprises a collar adapted to be structurally associated with the supported member, and said locking mechanism is rotatably supported by said collar, with said locking mechanism and said collar forming a sleeve surrounding said support post.

3. A support system according to claim 2, wherein said collar is contoured to complement a cross-sectional shape of said support post.

4. A support system according to claim 2, wherein said support post has a generally right equilateral triangular cross-section with a rounded right angular apex.

5. A support system according to claim 4, wherein said collar comprises first and second lateral sides and a rear section connecting said first and second lateral sides and having a rounded apex to complement the rounded right angular apex of said support post.

6. A support system according to claim 5, wherein said collar further comprises means for securing said locking mechanism.

7. A support system according to claim 6, wherein said securing means comprises a cylindrical shaft secured between said first and second lateral sides of said collar.

8. A support system according to claim 7, wherein said cylindrical shaft is secured between upper portions of said first and second lateral sides of said collar.

9. A support system according to claim 7, wherein said cylindrical shaft is secured between middle portions of said first and second lateral sides of said collar.

10. A support system according to claim 1, wherein said tapered portion of said wedge member extends along its entire length.

11. A support system according to claim 1, wherein said tapered portion of said wedge member extends along part of its length.

12. A support system according to claim 1, wherein said tapered portion of said wedge member extends along a lower part of its length.

13. A support system according to claim 1, wherein said wedge member is clipped on to said support post, with said locking mechanism having a rear face mating with an outer surface of said wedge member.

14. A support system according to claim 13, wherein said outer surface and said rear face are substantially flat to complement each other.

15. A support system according to claim 13, wherein said outer surface is convex and said rear face is concave to complement each other.

16. A support system according to claim 13, wherein said outer surface is angled and said rear face has an angled cavity to complement each other.

17. A support system according to claim 1, wherein when said locking mechanism is in the second position, the support means can pass over said support post and said wedge member.

18. A support system according to claim 1, with said support means being translatable relative to said support post, wherein when said support means translates in a first direction said locking mechanism passes over said wedge member and when said support means translates in a second direction said locking mechanism seats on said wedge member and creates a wedging force.

19. A support system according to claim 18, further comprising means for actuating said locking mechanism toward the second position when said support means slides in the first direction to allow said locking mechanism to pass over said wedge member.

20. A support system according to claim 1, wherein said locking mechanism has a flat lower portion.

21. A support system according to claim 1, wherein said locking mechanism has a rounded lower portion.

22. A support system according to claim 1, wherein said locking mechanism rotates about an axis when said surface abuts said wedge member.

23. A support system according to claim 1, wherein said locking mechanism rotates about an axis transverse to a longitudinal axis of said support post when said surface abuts said wedge member.

24. A system for supporting a member, said system comprising:

a support post having a longitudinal axis;

a wedge member with a tapered face and mounted to said support post; and support means adapted to be secured to the member for supporting the member to said support post, said support means forming a sleeve around said support post and seated on said support post and said mounted wedge member, wherein said support means is actuable between a first position compressing said wedge member and supporting the member and a second position not compressing said wedge member.

25. A system according to claim 24, wherein said locking mechanism in the first position supports the member by a wedge action with said wedge member.

26. A system according to claim 24, wherein said locking mechanism in the second position releases the compressive force applied to said support post and said wedge member.

27. A system according to claim 24, wherein said locking mechanism in the second position is slidable over said support post and said wedge member.

28. A system according to claim 24, wherein said support assembly comprises a collar adapted to be structurally associated with the member, with said locking mechanism rotatably supported on said collar.

29. A system according to claim 28, wherein said locking mechanism has a rear face mating with an outer surface of said wedge member.

30. A system according to claim 29, wherein said outer surface and said rear face are substantially flat to complement each other.

31. A system according to claim 29, wherein said outer surface is convex and said rear face is concave to complement each other.

32. A system according to claim 29, wherein said outer surface is angled and said rear face has an angled cavity to complement each other.

33. A system according to claim 28, wherein said collar includes first and second lateral sides and a rear section connecting said first and second lateral sides, said rear section shaped to complement a contour of said support post.

34. A system according to claim 33, wherein said collar further comprises means for securing said locking mechanism.

35. A system according to claim 34, wherein said securing means comprises a cylindrical shaft secured between said first and second lateral sides of said collar.

36. A system according to claim 35, wherein said cylindrical shaft is secured between upper portions of said first and second lateral sides of said collar.

37. A system according to claim 35, wherein said cylindrical shaft is secured between middle portions of said first and second lateral sides of said collar.

38. A system according to claims 28, wherein said locking mechanism has a flat lower portion.

39. A system according to claim 28, wherein said locking mechanism has a rounded lower portion.

40. A system according to claim 24, with said sleeve receiving said support post and wedge member and translatable relative thereto, wherein when said support assembly translates in a first direction said locking mechanism passes over said wedge member and when said support assembly translates in a second direction said locking mechanism seats on said wedge member and creates a wedging force.

41. A system according to claim 24, further comprising means for actuating said locking mechanism toward the second position when said support assembly slides in the first direction to allow said locking mechanism to pass over said wedge member.

42. A system according to claim 24, wherein said tapered face extends along an entire length of said wedge member.

43. A system according to claim 24, wherein said tapered face extends along part of a length of said wedge member.

44. A system according to claim 43, wherein said tapered face extends along a lower part of the length of said wedge member.

45. A system for supporting a member, said system comprising:

a support post having a longitudinal axis;

a wedge member with a tapered face and mounted to said support post;

a collar adapted to be secured to the member; and a locking mechanism mounted to said collar, said locking mechanism and said collar forming a sleeve surrounding said support post, wherein said locking mechanism is movable between a first position in which it compresses said wedge member thereby to support the member and a second position in which it does not compress said wedge member.

46. A system according to claim 45, wherein when said locking mechanism is in the first position, said sleeve engages said support post and wedge member and is seated thereon by a wedge action.

47. A system according to claim 45, wherein when said locking mechanism is in the second position, said sleeve is slidable over said support post and said wedge member.

48. A system according to claim 45, wherein when said locking mechanism is in the second position, the compressive force is released from said support post and said wedge member.

49. A system according to claim 45, wherein said locking mechanism has a rear face mating with an outer surface of said wedge member.

50. A system according to claim 49, wherein said outer surface and said rear face are substantially flat to complement each other.

51. A system according to claim 49, wherein said outer surface is convex and said rear face is concave to complement each other.

52. A system according to claim 49, wherein said outer surface is angled and said rear face has an angled cavity to complement each other.

53. A system according to claim 45, wherein said collar comprises first and second lateral sides and a rear section connecting said first and second lateral sides, said rear section shaped to complement a contour of said support post.

54. A system according to claim 53, wherein said collar further comprises means for securing said locking mechanism.

55. A system according to claim 54, wherein said securing means comprises a cylindrical shaft secured between said first and second lateral sides of said collar.

56. A system according to claim 55, wherein said cylindrical shaft is secured between upper portions of said first and second lateral sides of said collar.

57. A system according to claim 55, wherein said cylindrical shaft is secured between middle portions of said first and second lateral sides of said collar.

58. A system according to claim 45, wherein said support post has a generally right equilateral triangular cross-section with a rounded right angular apex.

59. A system according to claim 45, with said sleeve receiving said support post and wedge member and translatable relative thereto, wherein when said sleeve translates in a first direction said locking mechanism passes over said wedge member and when said sleeve translates in a second direction said locking mechanism seats on said wedge member and creates a wedging force.

60. A support system according to claim 59, further comprising means for actuating said locking mechanism toward the second position when said support means slides in the first direction to allow said locking mechanism to pass over said wedge member.

61. A system according to claim 45, wherein said tapered face extends along an entire length of said wedge member.

62. A system according to claim 45, wherein said tapered face extends along a part of a length of said wedge member.

63. A system according to claim 62, wherein said tapered face extends along a lower part of the length of said wedge member.

64. A system according to claim 45, wherein said locking mechanism has a flat lower portion.

65. A system according to claim 45, wherein said locking mechanism has a rounded lower portion.

66. A system according to claim 45, wherein said locking mechanism rotates between the first and second positions about an axis.

67. A system according to claim 66, wherein said locking mechanism rotates about an axis transverse to the longitudinal axis of said support post.

* * * * *

UNITED STATES PATENT AND TRADEMARK OFFICE

CERTIFICATE OF CORRECTION

PATENT NO. : 6,017,009
DATED : January 25, 2000
INVENTOR(S) : Robert K. Swartz et al.

It is certified that error appears in the above-identified patent and that said Letters Patent is hereby corrected as shown below:

Column 16,
Line 4, "locking" should read -- support means --.
Line 5, "mechanism" should be deleted.
Line 7, "locking" should read -- support means --.
Line 8, "mechanism" should be deleted.
Line 10, "locking" should read -- support means --.
Line 11, "mechanism" should be deleted.
Line 14, "assembly" should read -- means --.
Line 15, "member, with said" should read -- member and a --.
Line 45, "claims 28," should read -- claim 28, --.
Line 51, "assembly" should read -- means --.
Line 53, "assembly" should read -- means --.
Line 58, "assembly" should read -- means --.

Signed and Sealed this

Twenty-second Day of October, 2002

*Attest:*

*Attesting Officer*

JAMES E. ROGAN
*Director of the United States Patent and Trademark Office*